US011530504B2

(12) United States Patent
Hu

(10) Patent No.: US 11,530,504 B2
(45) Date of Patent: Dec. 20, 2022

(54) WASHING MACHINE WITH AUXILIARY WASHING UNIT

(71) Applicant: NINGBO JIMU ELECTRICAL APPLIANCE CO., LTD., Zhejiang (CN)

(72) Inventor: Jiebo Hu, Cixi (CN)

(73) Assignee: NINGBO JIMU ELECTRICAL APPLIANCE Co., LTD, Zhejiang (CN)

( * ) Notice: Subject to any disclaimer, the term of this patent is extended or adjusted under 35 U.S.C. 154(b) by 185 days.

(21) Appl. No.: 16/636,023

(22) PCT Filed: Aug. 2, 2018

(86) PCT No.: PCT/CN2018/098364
§ 371 (c)(1),
(2) Date: May 31, 2020

(87) PCT Pub. No.: WO2019/024896
PCT Pub. Date: Feb. 7, 2019

(65) Prior Publication Data

US 2020/0299889 A1 Sep. 24, 2020

(30) Foreign Application Priority Data

Aug. 2, 2017 (CN) ..... 201710651148.5

(51) Int. Cl.

| | |
|---|---|
| ***D06F 29/00*** | (2006.01) |
| ***D06F 1/02*** | (2006.01) |
| ***D06F 23/04*** | (2006.01) |
| ***D06F 39/14*** | (2006.01) |
| ***D06F 31/00*** | (2006.01) |
| *D06F 39/08* | (2006.01) |
| *D06F 58/20* | (2006.01) |

(52) U.S. Cl.
CPC ..... *D06F 29/005* (2013.01); *D06F 1/02* (2013.01); *D06F 23/04* (2013.01); *D06F 29/00* (2013.01); *D06F 31/00* (2013.01); *D06F 39/14* (2013.01); *D06F 39/088* (2013.01); *D06F 58/20* (2013.01)

(58) Field of Classification Search
None
See application file for complete search history.

(56) References Cited

U.S. PATENT DOCUMENTS

| | | | | |
|---|---|---|---|---|
| 2001/0023513 | A1* | 9/2001 | Monteiro | D06F 37/04 8/158 |
| 2015/0247276 | A1* | 9/2015 | Kim | D06F 37/26 68/27 |
| 2018/0363192 | A1* | 12/2018 | Jang | D06F 29/00 |

* cited by examiner

*Primary Examiner* — Cristi J Tate-Sims
(74) *Attorney, Agent, or Firm* — Raymond Y. Chan; David and Raymond Patent Firm

(57) ABSTRACT

A washing machine with an auxiliary washing unit includes a main body having a first opening and a first main washing space communicated with the first opening, a first auxiliary washing unit and a first cover, wherein the first auxiliary washing unit is juxtaposedly arranged with the first cover to jointly and portionly cover the first opening, and the first opening is capable of being portionly opened by opening the first cover for putting laundries into or taking laundries out of the first main washing space.

20 Claims, 14 Drawing Sheets

WASHING MACHINE WITH AUXILIARY WASHING UNIT

CROSS REFERENCE OF RELATED APPLICATION

This is a U.S. National Stage under 35 U.S.C. 371 of the International Application Number PCTCN2018/098364, filed Aug. 2, 2018, which claims priority to Chinese application number CN201710651148.5, filed Aug. 2, 2017.

BACKGROUND OF THE PRESENT INVENTION

Field of Invention

The present invention relates to a washing machine, and more particularly to a washing machine with an auxiliary washing unit.

Description of Related Arts

The washing machine is a kind of machine that is electrically powered to do the laundry. The washing machine can be classified into a stirring type, a whirlpool type, or a drum type according to different washing methods. The stirring type washing machine does laundry by rotating an agitator located at a center of a tub to the left and right. The whirlpool type washing machine provides friction force between water flow generated by rotating a pulsator left and right and the laundry to be washed, wherein the pulsator is mounted at the bottom of the rotatable tub and is in shape of a flat plate. The drum type washing machine washes laundries by rotating a drum having a plurality of lifters protruding along an inner surface after water and detergent are put into the drum.

The washing machine can be classified, according to its shape, into a top loader washing machine that laundries are loaded from the top or a front loader washing machine that laundries are loaded from the front. To the top loader washing machine, the laundries can be put into a rotary tub through an opening provided in the top surface. To the front loader washing machine, the laundries can be put into a rotary tub through an opening formed in a front side surface. Generally, the stirring type washing machine and the whirlpool type washing machine are implemented as a top loader washing machine, and a drum type washing machine is implemented as a front loader washing machine.

According to the current technology, such as a washing machine disclosed in Chinese patent publication number CN105189847A, the washing machine is designed with a laundry access opening communicating to a main washing space defined by a stationary tub and a rotary tub, wherein a hand-washing or independent washing space unit is arranged above the opening such that a side thereof is pivotally coupled above the opening or detachably arranged above the opening of the washing machine, for manually washing or independently washing the laundry that has hard dirt or small stain thereon in the upper washing space unit before it is putted into the lower main washing space. According to this conventional washing space unit, the water in the upper washing space unit will be poured down into the lower main washing space to be reused by pivotally flipping the upper washing space unit sidewardly or detaching the upper washing space unit from the opening of the washing machine, so as to avoid consuming extra washing water for the hand-washing or independent washing work conducted in the upper washing space unit, thereby reducing water consumption.

However, according to the above-mentioned prior Chinese patent publication number CN105189847A, when the laundries in the upper washing space unit require longer time to wash the hard dirt or small stains by hand or to soak longer time to soften the hard dirt or stain but, at the same time, the laundries in the lower main washing space are just finished washing and ready to be taken out for hanging to dry, or that when there are laundries that need to be added into the lower main washing space for washing and thus the upper washing space unit must be flipped to one side pivotally to uncover the opening, in this case, the softening or soaking work in the upper washing space unit must be interrupted and it is difficult to continue the softening or soaking work in the upper washing space unit simultaneously. If the upper washing space unit is pivotally flipped to one side, on one hand, extras work is required to take out the laundries in the upper washing space unit, and on the other hand, the washing water in the upper washing space unit will fall into the lower main washing space while the upper washing space unit is flipped to one side that is conflict to the washing operation in the lower washing space, thereby causing confusion and causing troublesome. Or else, the washing water in the upper washing space unit may need to be drained by a ground pipe from the washing machine that would require to refill the upper washing space unit with new water and cause unnecessary waste of water.

It will be a long felt need to all users to have an innovative washing machine that allows the laundries to be putted into and taken out of the lower main washing space without interrupting the soaking or softening in the upper washing space unit, or without affecting the hand-washing operation in the upper washing space unit, while without wasting washing water.

SUMMARY OF THE PRESENT INVENTION

The invention is advantageous in that it provides a washing machine with auxiliary washing unit to solve the above mentioned technical problems, wherein the washing machine does not interrupt softening or soaking work in an upper auxiliary washing unit while allowing the laundries to be putted into or taken out of the lower main washing space.

In the present invention, the foregoing and other objects and advantages are attained by a washing machine with auxiliary washing unit, according to a first embodiment adapted to solve the above technical problems, comprising:

a main washing machine body having a first opening and a first main washing space communicated with the first opening;

a first auxiliary washing unit; and a first cover, wherein the first auxiliary washing unit and the first cover are juxtaposedly arranged that jointly cover the first opening, such that the first opening is capable of being partly opened by opening the first cover for putting laundries into or taking laundries out of the first main washing space while the first auxiliary washing unit is remained disposing above the first opening.

In the present invention, the foregoing and other objects and advantages are attained by a washing machine with auxiliary washing unit, according to a second embodiment adapted to solve the above technical problems, comprising:

a main washing machine body having a first opening, a first main washing space communicated with the first opening, a second opening, and a second main washing space communicated with the second opening;

a first auxiliary washing unit; and a first cover, wherein the first auxiliary washing unit and the first cover are juxtaposedly arranged that jointly cover a portion of the first opening, wherein the first opening is capable of being partly opened by opening the first cover for putting laundries into or taking laundries out of the first main washing space.

In the present invention, the foregoing and other objects and advantages are attained by a washing machine with auxiliary washing unit, according to a third embodiment adapted to solve the above technical problems, comprising:

a main washing machine body having a first opening, a first main washing space communicated with the first opening, a second opening, and a second main washing space communicated with the second opening;

a first auxiliary washing unit; and a first cover, wherein the first auxiliary washing unit and the first cover are juxtaposedly arranged that jointly cover the first opening, such that the first opening is capable of being partly opened by opening the first cover for putting laundries into or taking laundries out of the first main washing space.

In the present invention, the foregoing and other objects and advantages are attained by a washing machine with auxiliary washing unit, according to a fourth embodiment adapted to solve the above technical problems, comprising:

a main washing machine body having a first opening, a first main washing space communicated with the first opening, a second opening, and a second main washing space communicated with the second opening;

a first auxiliary washing unit;

a first cover; and a second cover, wherein the first auxiliary washing unit, the first cover and the second cover are juxtaposedly arranged that the first auxiliary washing unit and the first cover jointly cover the first opening and the first auxiliary washing unit and the second cover jointly cover the second opening, wherein the first opening and the second opening are capable of being partly opened by opening the first cover and the second cover respectively for putting laundries into or taking laundries out of the first main washing space and the second main washing space.

In the present invention, the foregoing and other objects and advantages are attained by a washing machine with auxiliary washing unit, according to a fifth embodiment adapted to solve the above technical problems, comprising:

a main washing machine body having a first opening, a first main washing space communicated with the first opening, and a second opening;

a second drying unit communicated with the second opening;

a first auxiliary washing unit;

a first cover; and a second cover, wherein the first auxiliary washing unit, the first cover and the second cover are juxtaposedly arranged that the first auxiliary washing unit and the first cover jointly cover the first opening, and the first auxiliary washing unit and the second cover jointly cover the second opening, such that a portion of the first opening is capable of being opened by opening the first cover, and a portion of the second opening is capable of being partly opened by the opening the second cover, adapted for putting laundries into or taking laundries out of the first main washing space and the second drying unit.

In the present invention, the foregoing and other objects and advantages are attained by a washing machine with auxiliary washing unit, according to a sixth embodiment adapted to solve the above technical problems, comprising:

a main washing machine body having a first opening, a first main washing space communicated with the first opening, a second opening, and a second main washing space communicated with the second opening;

a first auxiliary washing unit;

a first cover, wherein the first auxiliary washing unit and the first cover are juxtaposedly arranged that jointly cover the first opening, wherein the first opening is capable of being opened by opening the first cover for putting laundries into or taking laundries out of the first main washing space;

a second auxiliary washing unit; and a second cover, wherein the second auxiliary washing unit and the second cover are juxtaposedly arranged that jointly cover the second opening, wherein the second opening is capable of being opened by opening the second cover for putting laundries into or taking laundries out of the second main washing space.

According to one embodiment of the present invention, the main washing machine body of the washing machine further has a third main washing space and a third opening communicated with the third main washing space.

According to one embodiment of the present invention, the first main washing space or the second main washing space or the third main washing space may be embodied as a washing unit with washing function or a spin dryer unit with drying function, so as to meet the requirement of different users.

According to one embodiment of the present invention, practically, a washboard is provided to place on the first auxiliary washing unit for washing laundries, or alternatively, the washboard is hinged with the first auxiliary washing unit for ease of scrubbing the laundry and washing the laundry more cleanly.

According to one embodiment of the present invention, preferably, the first auxiliary washing unit is movably arranged with the main washing machine body, so that when the first auxiliary washing unit is moved away from the first opening, the entrance for putting laundries into or taking laundries out of the first main washing space is enlarged so as to enable the laundries to be easily putting into or taking out of the first main washing space.

In addition, when the first and second auxiliary washing units are arranged accordingly, it is preferred to arranged the second auxiliary washing unit to be able to move with respect to the main washing machine body, so that when the second auxiliary washing unit is moved away from the second opening, the entrance for putting laundries into or taking laundries out of the second main washing space is enlarged, so as to enable the laundries to be easily putting into or taking out of the first main washing space.

Additional advantages and features of the invention will become apparent in comparison with the conventional art as follows.

One advantage of the washing machine according to the present invention is that: since the first auxiliary washing unit is directly arranged at the opening of the washing machine, the opening is partially covered and sheltered without adversely affecting the opening operation of the cover of the washing machine and the laundries to be putting into or taking out of the first main washing space, so that the operation of the washing machine would not interrupt the softening or soaking work in the upper auxiliary washing unit or affecting the hand-washing operation inside the upper first auxiliary washing unit while allowing the laundries to be putting into or taking out of the lower main washing space. Such arrangement of the present invention also avoids wasting the washing water and the hand-washing operation does not require additional washing space that effectively saves working space and time.

Another advantage of the invention is that, during the operation of the washing machine, it is found that for washing and drying laundry once a day, the laundry will be putting into and taking out of the main washing space through the opening of the main washing machine body for one time. That is there are two times for accessing the opening of the main washing space per day. In other words, for each washing and drying laundry operation, the opening is required to be accessed twice for putting the laundries into or taking the laundries out therethrough so that the size of the opening would not substantially affect the placement of laundries even though the opening has a smaller size. However, it takes more time for softening or soaking and hand-washing the hard dirt and stain of laundries every day or every time. Accordingly, the present invention provides the first auxiliary washing unit arranged on the main washing machine body and takes use of a portion of this first opening located above the first main washing space for the first auxiliary washing unit to rest thereon, and thus the size of the first auxiliary washing unit can be enlarged to provide more hand-washing space and volume for this upper hand-washing container. Therefore, the user can spend more time inside this hand washing container for laundry hand-washing and soaking operation to soften hard dirt on the laundries. The present invention takes advantage of the position of the first opening and use of the space provided on the first opening for the first auxiliary washing unit. It is worth mentioning that even a smaller size of the first opening is provided, the putting in and taking out of the laundries in the first washing space may normally be operated through the first opening. Of course, if a washing machine without provided with the auxiliary washing unit, it may normally putting laundries into or taking laundries out of the main washing space, but the auxiliary washing unit as arranged in the present invention does provide unexpected results and much utility advantages by having a larger and very useful hand-washing container with bigger size, so that while without enlarging the occupying space and changing the structure of the washing machine, a manual washing container is provided for hand-washing laundry, soaking laundry for softening hard dirt and stains, face washing, teeth brushing, and etc., meeting the substantial needs of the user. The present invention is non-obvious and has outstanding substantive subject matters and significant improvement.

Another advantage of the present invention is that, the washing machine of the present application does not need large area or living space to do the laundry. The washing machine provides the first main washing space at a lower part thereof for washing laundries and an upper hand washing container for various washing operations, such as washing faces or brushing teeth, as well as allowing the washing machine to put laundries into or take laundries out of the first main washing space without interrupting the softening or soaking work inside the upper hand washing container.

Another advantage of the present invention is that, the washing machine provides a lower first main washing space for doing laundries and an upper hand washing container for face washing or tooth brushing operations as an additional washing sink that avoids the waiting in line condition for a family to use the only one bathroom washing sink for face washing operation or tooth brushing operation in the morning or evening so as to alleviates the pressure using the same washing sink and saves time.

Another advantage of the present invention is that, in comparison with the conventional art, allows the washing machine to wash laundries in a first main washing space while providing an independent hand-washing container equipped with independent draining arrangement for discharging dirty water to outside, while ensuring the dirty water formed after the hand-washing laundries, face washing and teeth brushing operations in the hand-washing container space would not discharging into lower the main washing space.

Another advantage of the present invention is that, in comparison with the background art, while the laundries is putting into or taking out of the lower first main washing space, the washing water in the upper first auxiliary washing unit would not fall into the lower first main washing unit, that prevents from causing confusion and troublesome with the washing operation in the first main washing space, and avoids discharging the washing waster from discharging outside the washing machine to a ground pipeline to prevent a waste of as well as refilling the washing water in the first auxiliary washing unit.

Another advantage of the present invention is that, one washing machine of the present invention can be simultaneously provided with two work stations (operated by two users). That is, one work station (one user) allows performing softening, soaking, washing laundries or washing face in the first auxiliary washing unit while another station (another user) allows operations of putting laundries into, putting detergent into or taking laundries out of the first main washing space without interfering with each other, and thus improving working efficiency.

Another advantage of the present invention is that, to tenant with unstable work and dweller with smaller living space, as long as the user owns a washing machine with hand-washing container of the present invention, he or she seems substantially having another hand-washing container for washing laundry, face washing, or teeth brushing operation without the need to purchase another bath washing sink that significantly saves his or her living space to place the sink and purchasing expense of the sink.

In addition, the first auxiliary washing unit can be independent from the normal washing method and thus improving the washing efficiency.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any user skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
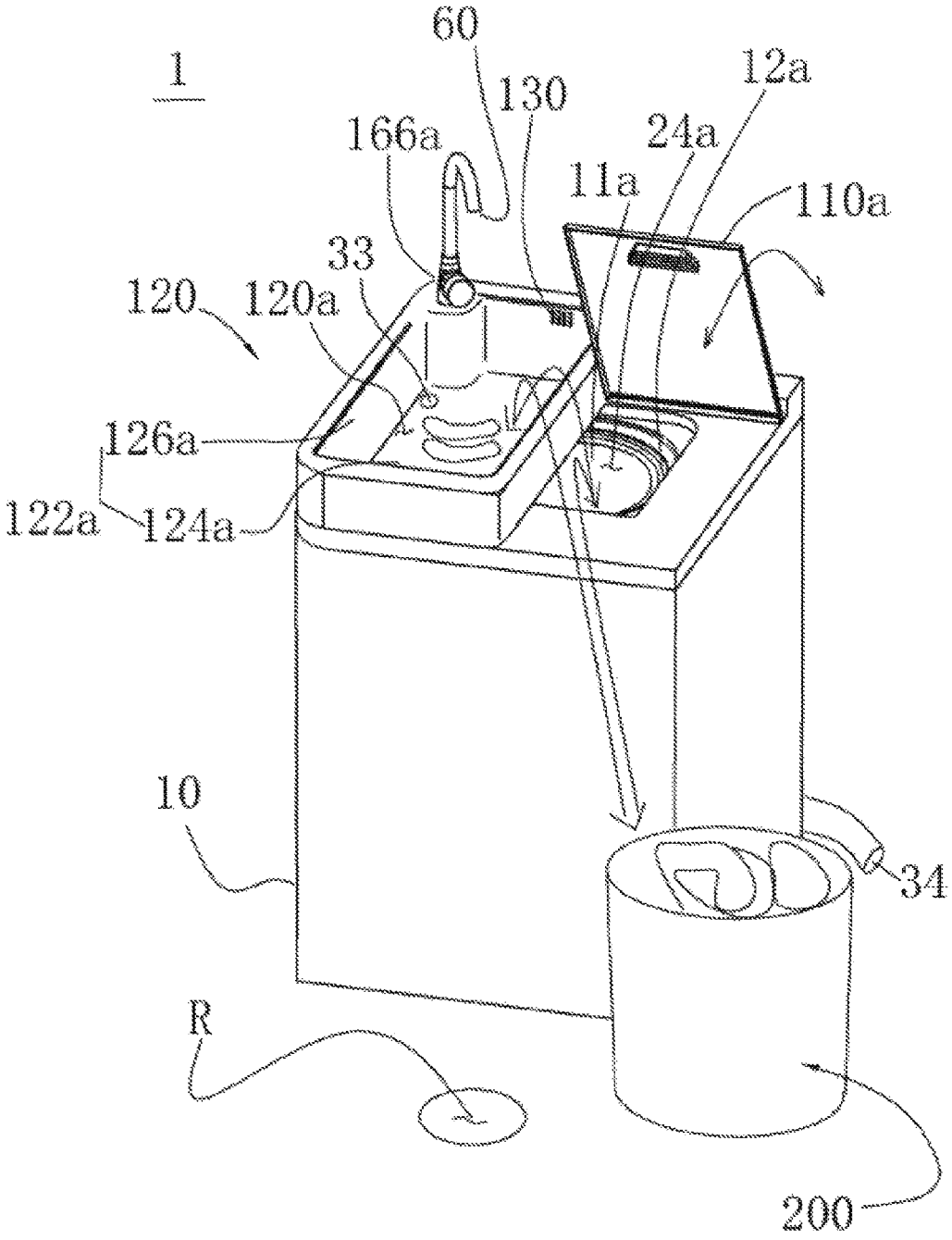
FIG. 1 is a perspective view of a washing machine according to a first preferred embodiment of the present invention.
Figure 2:
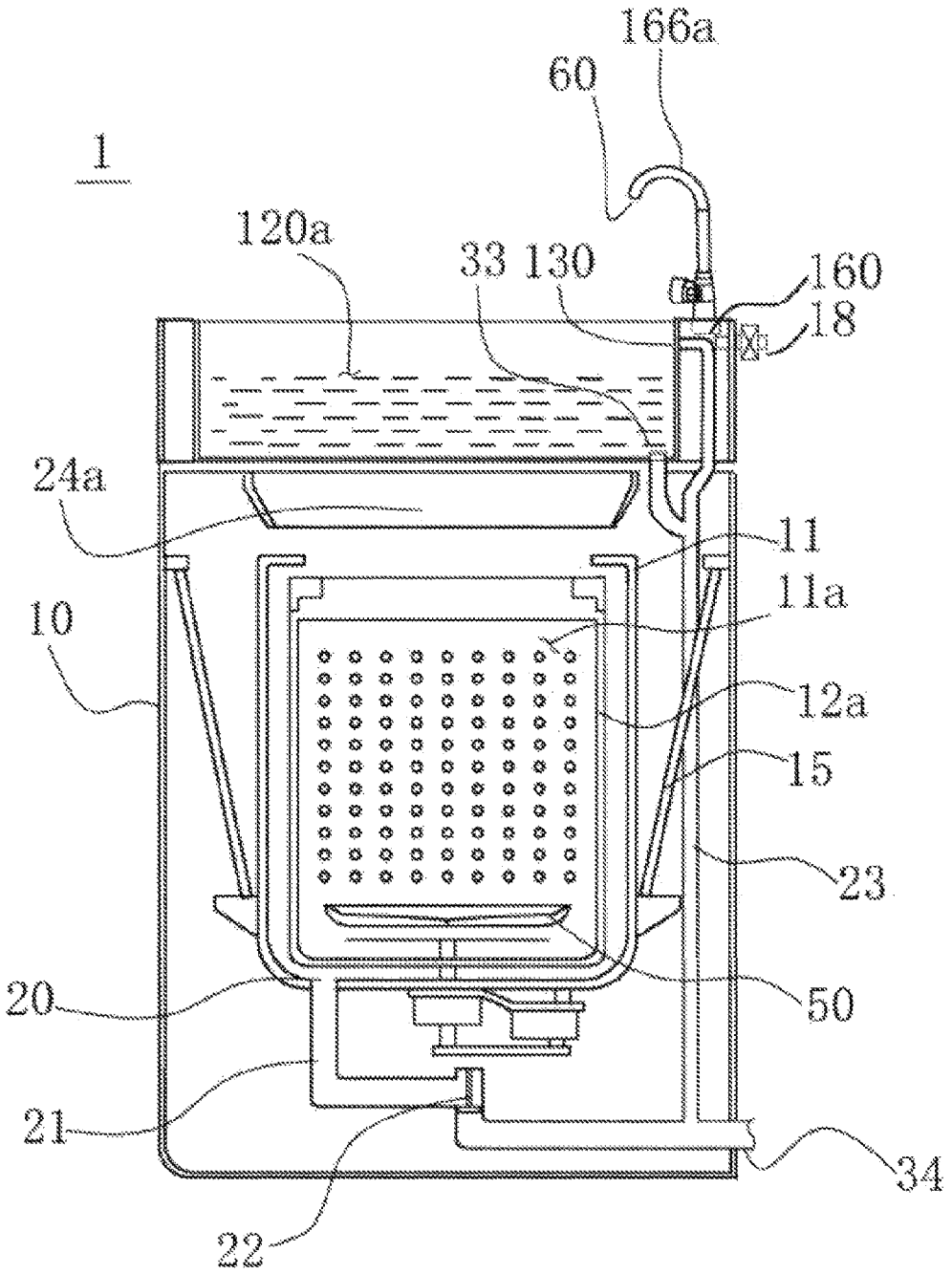
FIG. 2 is a sectional view of the washing machine according to the above first preferred embodiment of the present invention.

Referring to FIG. 1 and FIG. 2, a washing machine 1 according to a first preferred embodiment of the present invention comprises a main washing machine body 10 providing a housing of the washing machine 1, a suspension device 15, a stationary tub 11 supported in the main washing machine body 10 by means of the suspension device 15 and configured for receiving washing water therein, a rotary tub 12*a* rotatably arranged within the stationary tub 11 to define a first main washing space 11*a* therein, and a pulsator 50 arranged in the rotary tub 12*a* for generating water flow in the rotary tub 12*a*.

The main washing machine body 10 has a first opening 24*a* formed on a top of the main washing machine body 10, wherein the first opening 24*a* is communicated with the first main washing space 11*a* of the washing machine 1. The washing machine 1 further comprises a first auxiliary washing unit 120 which is juxtaposedly arranged with the first cover 110*a* to jointly cover the first opening 24*a* of the first main washing space 11*a*. That is, the first auxiliary washing unit 120 is positioned over the first opening and covers a first portion of the first opening 24*a* while the first cover 110*a* covers another second portion of the first opening 24*a* such that the first cover 110*a* is able to be opened to open a portion of the first opening 24*a* (that is the second portion of the first opening 24*a*) for ease of taking laundries out or putting laundries into the first main washing space 11*a*, and that the laundries to be washed may be putted into the rotary tub 12*a* by opening the first cover 110*a*, wherein the means for connecting the first cover with the main washing machine body can be appropriate traditional art.

The above-mentioned first auxiliary washing unit 120 is also defined as a hand-washing container 120*a* which can be used for soaking laundry for softening hard dirt and stains on the laundry, washing laundries or washing face of the user.

The position illustrated as R in FIG. 1 is the position where the user stands. When the user opens the first cover 110*a*, the laundry to be washed is putted into the rotary tub 12*a* by opening the first opening 24*a*. Apparently, the operation of putting laundries into or taking laundries out of the rotary tub 12*a* through the first opening 24*a* will not interrupt and affect the soaking of the laundries and the softening of hard dirt and stains thereon in the hand-washing container 120*a* without wasting washing water.

The washing machine 1 according to the present invention can achieve synergies of user's space requirements for laundries 200 inside the laundry basket, laundries in the first main washing space 11*a*, and laundries in the hand-washing container 120*a*.

The present invention does not increase floor space for the washing machine 1 and does not occupy much of the user's living space while obtaining multiple washing operation spaces. Moreover, the washing machine allows the operation of putting laundries into or taking laundries out of the first main washing space 11*a* without interrupting the softening or soaking work in the upper hand-washing container 120*a*.

Therefore, the washing machine provides available coordination functions for users to achieve efficient washing, save time and reduce operation intensity.

Optionally, the first auxiliary washing unit 120 may be made of thermoplastic resin. The components of the first auxiliary washing unit 120 may be made of acrylonitrile-butadiene-styrene (ABS) material or ceramic material or pottery, or stainless steel made by molding as required. However, the present invention is not limited in materials, and the first auxiliary washing unit 120 may be made of any material having sufficient impact resistance and rigidity for hand-washing.

The hand-washing container 120*a* comprises a bottom portion 124*a* and a side portion 126*a* forming a unit body 122*a*.

The bottom portion 124*a* as a factor determining a depth of the hand-washing container 120*a* may be shaped as a flat or curved configuration. Alternatively, the side portion 126*a* may be shaped to be inclined towards the bottom portion 124*a*.

The bottom portion 124*a* and the side portion 126*a* form the recessed hand-washing container 120*a*, enabling hand-washing operation independently while washing water is stored and contained in the hand-washing container 120*a*.

The hand-washing container 120*a* further comprises one or more frictional protrusions (not shown in drawings) protruded on the unit body 122*a* to promote assistance for washing. Specifically, the one or more friction protrusions may be protruded from the side portion 126*a*, or protruded from at any position on the inner surface of the hand-washing container 120*a*. The one or more friction protrusions increase the friction force between the laundries during hand-washing, so that the dirt and stains are easily washed off the laundries. However, the shape and arrangement of the friction protrusion are not limited in the present invention.

The first hand-washing unit 120 (hand-washing container 120*a*) comprises an external water supply valve 18. A water supply pipe (not shown in drawings) for supplying washing water into the stationary tub 11 is mounted in an upper portion of the stationary tub 11, wherein one end of the water supply pipe is configured to be connected with the external water supply valve 18. Preferably, the other end of the water supply pipe is connected with a detergent supply device. The washing water supplied through the water supply pipe is injected into the stationary tub 11 together with the detergent from a detergent supply unit (not shown in drawings).

The stationary tub 11 has a drain outlet 20 formed at a bottom of the stationary tub 11 for discharging washing water received therein, and comprises a first drain pipe 21 connected to the drain outlet 20. The stationary tub 11 further comprises a drain valve 22 mounted on the first drain pipe 21 to control drainage of washing water. An outlet of the drain valve 22 may be connected with a second drain pipe 34 for discharging washing water to outside.

The first main washing space 11*a* and the hand-washing container 120*a* are separated and independent from each other, so that washing can be performed in the first main washing space 11*a* and the hand-washing container 120*a* independently. In addition, the washing in the first main washing space 11*a* and the hand-washing container 120*a* may be operated separately or simultaneously.

Referring to FIG. 2, the washing machine 1 according to the first embodiment of the present invention further comprises a water supply device 160, wherein one end of the water supply pipe is connected with the water supply valve 18 for supplying water to the water supply device 160 of the hand-washing container 120*a* and into the first main washing space 11*a*.

The water supply device 160 of the hand-washing container 120*a* comprises an auxiliary water supply pipe or faucet 166*a* having an auxiliary water supply outlet 60 provided at one side of the hand-washing container 120*a* to supply washing water through the auxiliary water supply pipe 166*a* into the hand-washing container 120*a* for laundry washing or hand washing. The hand-washing container 120*a* may simply provide the auxiliary water supply outlet 60 at one side thereof for supplying washing water into the hand-washing container 120*a* directly via the auxiliary water supply outlet 60.

The hand-washing container 120*a* further has an auxiliary drain outlet 33 provided at the bottom portion 124*a* thereof for discharging the washing water contained in the hand-washing container 120*a*.

The auxiliary drain outlet 33 may be embodied as a hole formed in the bottom 124*a* of the hand-washing container 120*a*, or may be embodied as an individual switch member.

The hand-washing container 120*a* further has an overflow opening 130 formed at an upper position of the side portion 126*a* so that the overflowing washing water in the hand-washing container 120*a* can be discharged therethrough when it is overfull preventing water contained in the hand-washing container 120*a* from overflowing from the top edge of the side portion 126*a*.

The washing machine body 10 further comprises a third drain pipe 23 arranged therein, which has one end connected to the overflow opening 130 and another end being join and communicate with the second drain pipe 34, wherein the overflowing water flowing out of the overflow opening 130 is discharged through the second drain pipe 33 to outside.

In the present invention, the third drainage pipe 23 may also preferably be configured to directly and individually discharge to the outside.

Figure 11:
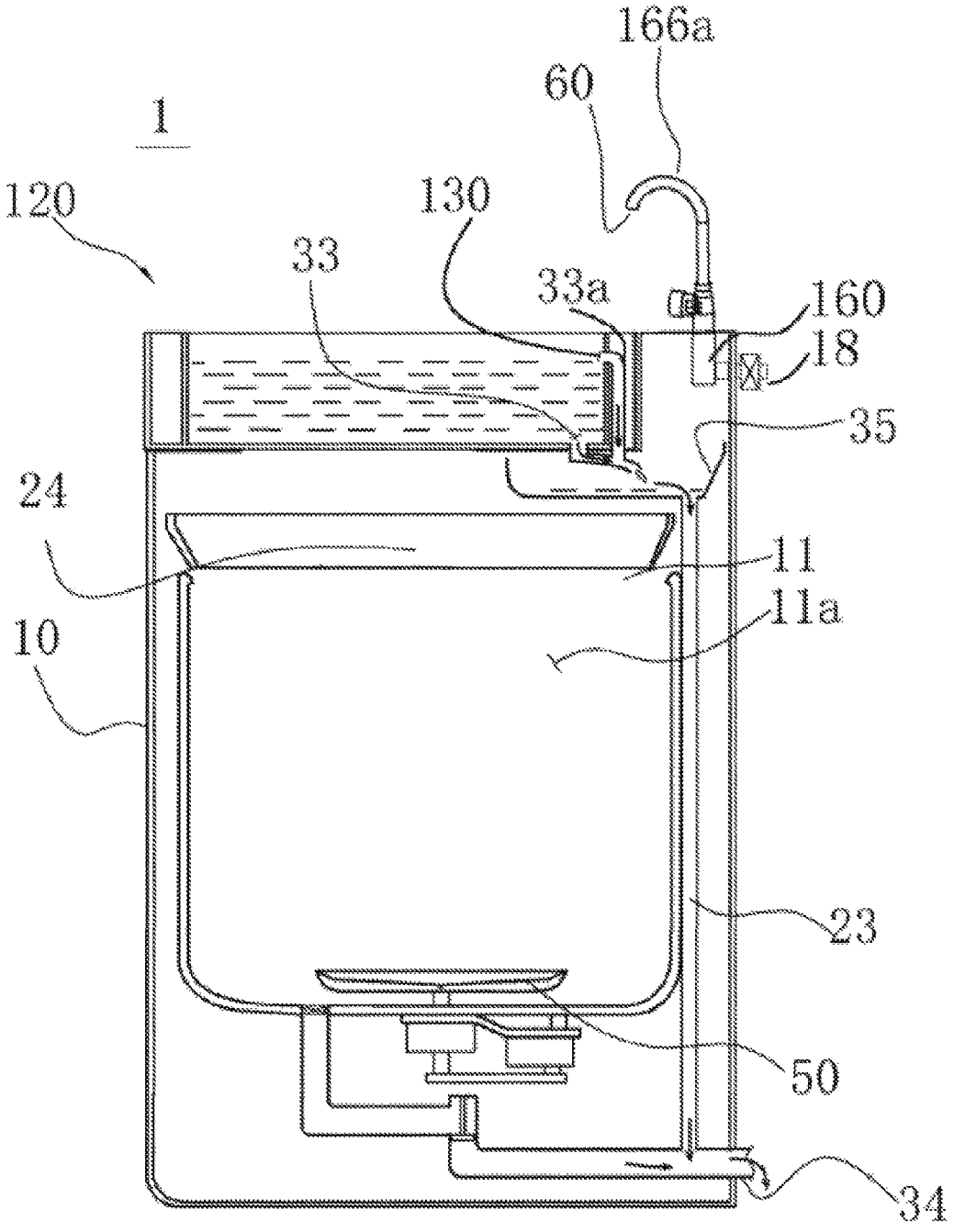
FIG. 11 is a sectional view of the washing machine according to an eighth preferred embodiment of the present invention, illustrating the main washing space of the washing machine with washing function only and without drying function.
Figure 12:
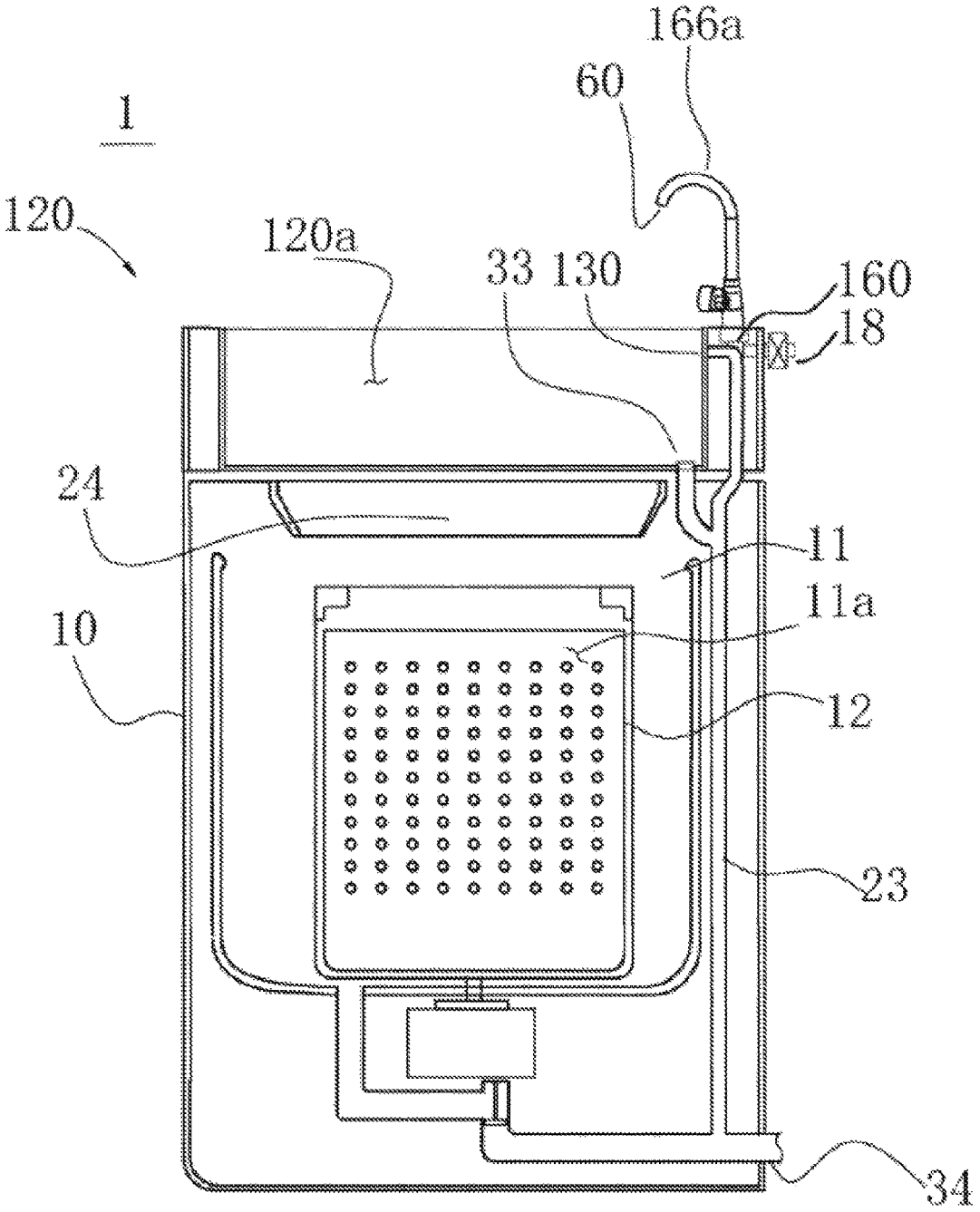
FIG. 12 is a sectional view of the washing machine according to a ninth preferred embodiment of the present invention, illustrating the main washing space of the washing machine with drying functional only.

Alternatively, the first main washing space 11*a* of the washing machine 1 as shown in this embodiment is not limited to the structure comprising the rotary tub 12*a*, the stationary tub 11 and the pulsator 50. In other words, as shown in FIG. 11, the first main washing space 11*a* may be embodied as the stationary tub 11*a* provided with the pulsator 50 therein but not the rotary tub 12*a*, and thus no rotary tub 12*a* is provided in the washing machine as shown in FIG. 11. Or, as shown in FIG. 12, the first main washing space 11*a* may be embodied as a single dehydration, spin-drying, or dryer function of drying laundries without washing function, wherein the main washing machine body 10 is merely a dryer machine.

Hereinafter, a washing machine according to a second preferred embodiment of the present invention is illustrated, wherein those components and configurations having same structure as the above first preferred embodiment is not repeatedly described in the following.

Figure 3:
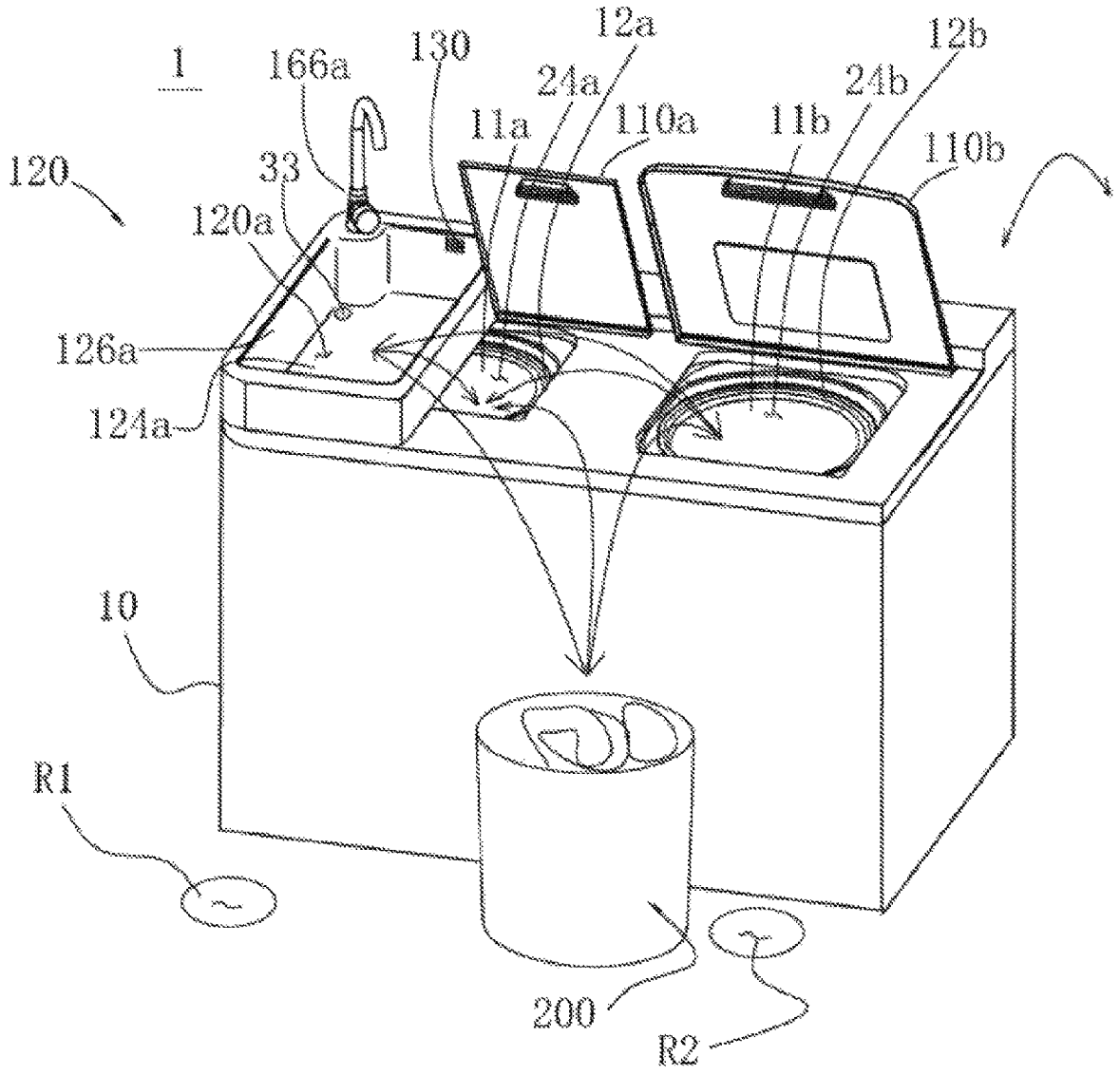
FIG. 3 is a perspective view of the washing machine according to a second preferred embodiment of the present invention.

Referring to FIG. 3, the washing machine 1 according to the second preferred embodiment of the invention comprises a main washing machine body 10 and a first auxiliary washing unit 120. The main washing machine body 10 has a first opening 24*a* formed at one top side thereof, a first main washing space 11*a* communicated with the first opening 24*a*, a second opening 24*b* provided at another top side thereof, and a second main washing space 11*b* communicated with the second opening 24*b*. The first auxiliary washing unit 120 and the first cover 110*a* are arranged juxtaposedly to collectively cover the first opening 24*a* of the first main washing space 11*a*. The first cover 110*a* is configured to be capable of opening or closing a portion of the first opening 24*a* for putting laundries into or taking laundries out of the first main washing space 11*a*. The second cover 110*b* is configured to be capable of opening or closing the second opening 24*b* for putting laundries into or taking laundries out of the second main washing space 11*b*.

The main washing machine body 10 of the washing machine 1 is also provided with the stationary tubs 11 and rotary tubs 12 corresponding to the first main washing space 11*a* and the second main washing space 11*b*. The rotary tubs 12 are correspondingly defined as a first rotary tub 12*a* and a second rotary tub 12*b*. Each of the rotary tubs 12*a*, 12*b* comprises the pulsator 50 arranged therein.

The position illustrated as R2 in FIG. 3 is the position where the user stands. When the user opens the first cover 110*a*, the laundry to be washed can be putted into the rotary tub 12*a* by opening the first opening 24*a*. It is apparent that the operation of putting laundries into or taking laundries out of the rotary tub 12*a* through the first opening 24*a* would not interrupt or affect the laundry soaking and softening works within the hand-washing container without wasting washing water.

The first auxiliary washing unit 120 is also defined as a hand-washing container 120*a* which can be used for soaking laundries to soften hard dirt and stains thereon, face washing or teeth brushing.

The above-mentioned washing machine can achieve synergies of user's space requirements of different kinds of laundries 200 operation inside the laundry basket, the first main washing space 11*a*, and the hand-washing container 120*a*, and the second main washing space 11*b*.

The washing machine as shown in FIG. 3 in comparison with the washing machine as shown in FIG. 1 provides more coordination functions for users to choose, and may better achieve efficient washing, save time, and reduce operation intensity.

Optionally, the washing machine with multiple tubs according to the second preferred embodiment can be embodied in structure as a two-tub, three-tub, four-tub, or five-tub configuration.

Optionally, as shown in FIG. 12, the washing machine with multiple tubs according to this embodiment is not limited to the structure comprising the rotary tub 12*a*, the stationary tub 11 and the pulsator 50. The first main washing space 11*a* and the second washing space 11*b* may be embodied with a single dehydration, spin-drying, or dryer function for drying laundries without washing function.

Optionally, as shown in FIG. 11, the washing machine with multiple tubs according to this embodiment is not limited to the structure comprising the rotary tub 12*a*, the stationary tub 11 and the pulsator 50. The first main washing space 11*a* or the second washing space 11*b* may be embodied with washing function only for washing laundries without drying function.

The washing machine according to the second preferred embodiment can be operated by two users standing at the R1 and R2 positions respectively as illustrated in FIG. 3 for operations simultaneously.

One user standing at the position R1 may perform face washing or hand washing laundries for softening hard dirt and soaking laundries inside the hand-washing container 120*a*. Another user standing at the position R2 may perform the operation of putting laundries into or taking laundries out of the second main washing space 11*b*, wherein both users would not interfere with each other.

Hereinafter, a washing machine according to a third preferred embodiment of the present invention is illustrated, wherein the components and configurations which are the same as the above first and second preferred embodiments are not being repeatedly described in the following.

Figure 4:
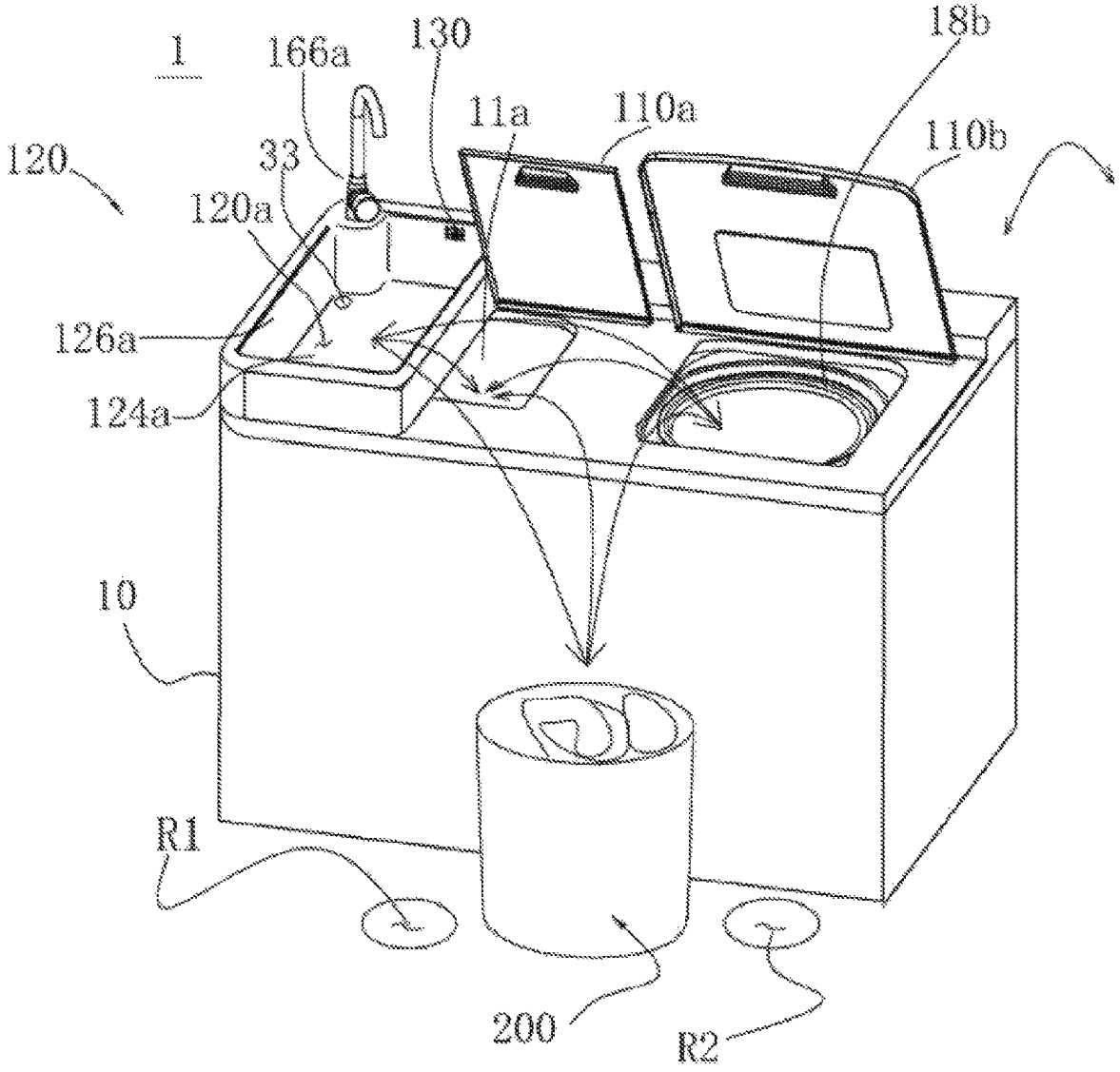
FIG. 4 is a perspective view of the washing machine according to a third preferred embodiment of the present invention.

Referring to FIG. 4, the washing machine according to the third preferred embodiment of the present invention comprises: a main washing machine body 10 and a first auxiliary washing unit 120. The main washing machine body 10 has a first opening 24*a* formed at one top side thereof, a first main washing space 11*a* communicated with the first opening 24*a*, and a second opening 24*b* formed at another top side thereof, and comprises a second dryer unit 18*b* communicated with the second opening 24*b*. The first auxiliary washing unit 120 and the first cover 110*a* are arranged juxtaposedly to collectively cover the first opening 24*a* of the first main washing space 11*a*. The first cover 110*a* is configured to be capable of opening or closing a portion the first opening 24*a* so that the laundries are able to be putting into or taking out of the first main washing space 11*a* through the portion of first opening 24*a* after opening the first cover 110*a*. The second cover 110*b* is configured to be capable of opening or closing the second opening 24*b* for putting laundries into or taking laundries out of the second dryer unit 18*b*.

Similarly, the main washing machine body 10 of the washing machine 1 is provided with the stationary tub and the rotary tub at a position corresponding to the first main washing space 11*a*, and the pulsator is also provided in the rotary tub correspondingly.

The above-mentioned first auxiliary washing unit 120 is also defined as a hand-washing container 120*a* which can be used for soaking laundries for softening hard dirt and stains thereon, washing laundries, or washing user's face.

The position illustrated as R1 in FIG. 4 is the position where the user stands. When the user opens the first cover 110*a*, the laundries 200 to be washed would be putted into the rotary tub 12*a* through the first opening 24*a* by opening the first cover 110*a*. The operation of putting laundries into or taking laundries out of the rotary tub 12*a* through the first opening 24*a* would not interrupt or affect the laundry works in the hand-washing container, including the soaking of the laundries for softening hard dirt and stains thereon without wasting washing water.

The above-mentioned washing machine can achieve synergies of user's space requirements of different kinds of laundries 200 operation inside the laundry basket, the first main washing space 11*a*, the hand-washing container 120*a*, and the second dryer unit 18*b*.

The washing machine as shown in FIG. 4 in comparison with the washing machine as shown in FIG. 1 has more coordination functions for users to choose, and may achieve better efficient washing, save time, and reduce operation intensity.

The washing machine in this embodiment can be operated at the same time by two users standing at the positions illustrated as the marks R1 and R2 respectively, wherein both users would not interfere with each other. In other words, one user standing at the position R1 may conduct face washing or hand washing laundries such as soaking laundries to soften the hard dirt and stains thereon inside the hand-washing container 120*a*, while another user standing at the position R2 may operate the putting in and taking out the laundries from the second dryer unit 18*b*.

Hereinafter, a washing machine according to a fourth preferred embodiment of the present invention is illustrated, wherein those component and configuration which are the same as the above first, second and third preferred embodiments are not repeatedly described in the following.

Figure 5:
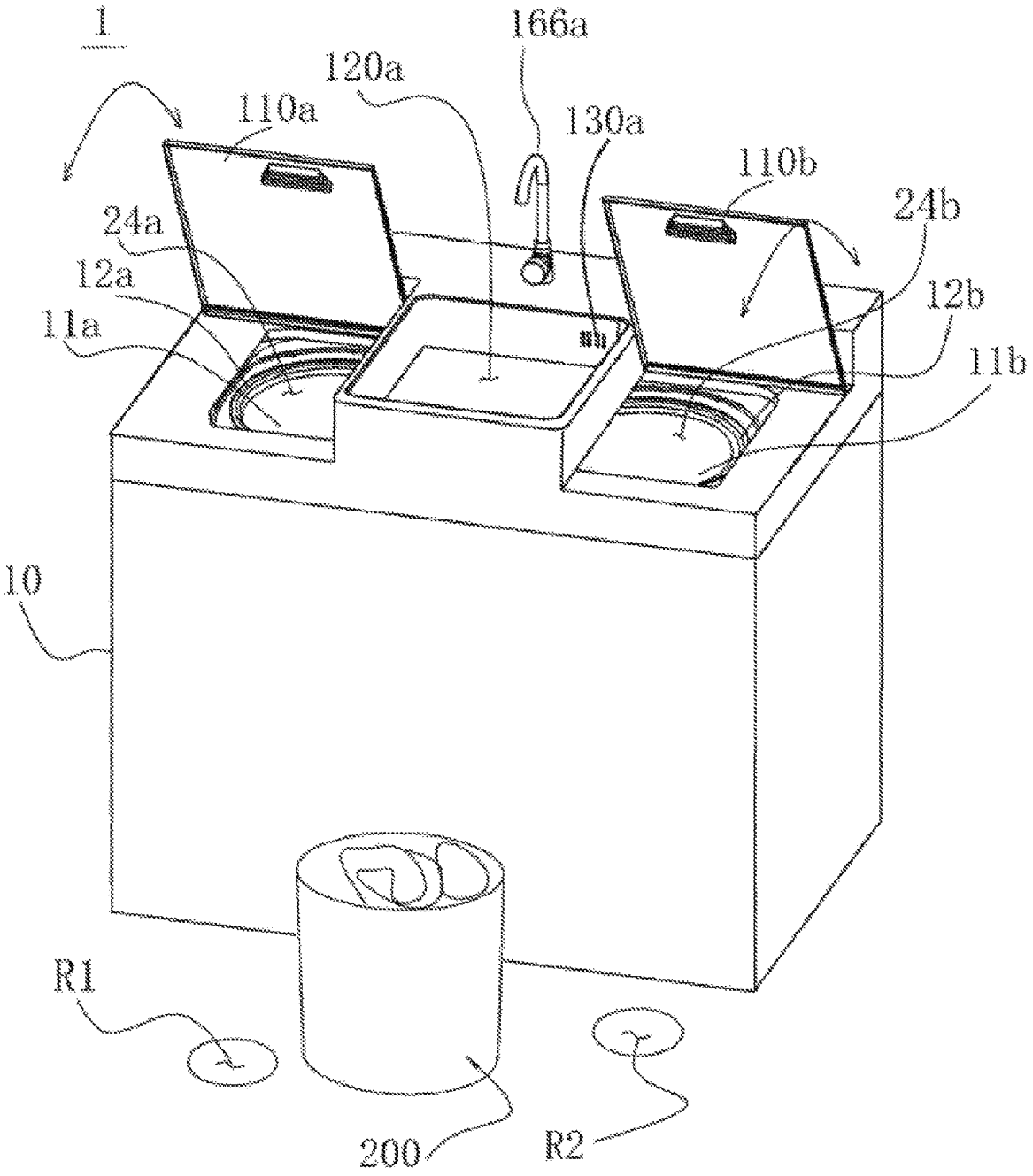
FIG. 5 is a perspective view of the washing machine according to a fourth preferred embodiment of the present invention.

Referring to FIG. 5, the washing machine according to the fourth preferred embodiment of the present invention comprises a main washing machine body 10, a first cover 110*a*, a second cover 110*b*, and a first auxiliary washing unit 120. The main washing machine body 10 has a first opening 24*a* provide at one top side thereof, a first main washing space 11*a* communicated with the first opening 24*a*, a second opening 24*b* provided at another top side thereof, and a second main washing space 11*b* communicated with the second opening 24*b*, wherein the first auxiliary washing unit 120 is arranged on the main washing machine body 10 and positioned between the first main washing space 11*a* and the second main washing space 11*b* and configured to cover a portion of the first opening 24*a* of the first main washing space 11*a* and a portion of the second opening 24*b* of the second main washing space 11*b*. In other words, a portion of the first auxiliary washing unit 120 and the first cover 110*a* are arranged juxtaposedly and cover the first opening 24*a*, and another portion of the first auxiliary washing unit 120 and the second cover 110*b* are arranged juxtaposedly and cover the second cover 110*b*.

The above-mentioned first auxiliary washing unit 120 is also defined as a hand-washing container 120*a* which is used for hand washing operation, including soaking laundries for softening hard dirt and stains, or washing user's face.

The position illustrated as R1 in FIG. 5 is the position where the user stands. When the user opens the first cover 110*a*, the laundries to be washed may be putted into the first rotary tub 12*a* through the first opening 24*a* by opening the first cover 110*a*, wherein the operation of putting laundries into or taking laundries out of the first rotary tub 12*a* through the first opening 24*a* would not interrupt or affect the laundries in the hand-washing container to be soaked for softening the hard dirt and stains without wasting washing water.

When the user opens the second cover 110*b*, the laundries to be washed may be putted into the second rotary tub 12*b* through the second opening 24*b* after opening the second cover 110*b*, wherein the operation of putting laundries into or taking laundries out of the second rotary tub 12*b* through the second opening 24*b* would not interrupt or affect the laundries in the hand-washing container to be soaked for softening the hard dirt and stains without wasting washing water.

The above-mentioned washing machine can achieve synergies of user's space requirements of different kinds of laundries 200 operation inside the laundry basket, the first main washing space 11*a*, the hand-washing container 120*a*, and the second main washing space 11*b*.

The washing machine as shown in FIG. 5 in comparison with Compared with the washing machine as shown in FIG. 1 has more coordination functions for users to choose, and may achieve better efficient washing, save time, and reduce operation intensity.

The present invention does not increase the floor space for the washing machine 1 and does not occupy much of the user's living space while obtaining multiple washing operation spaces. Moreover, the washing machine allows the operation of putting laundries into or taking laundries out of the first main washing space 11*a* and the second main washing space 11*b* while the hand washing operation, such as soaking laundries to soften the hard dirt and stains thereon, in the upper hand-washing container 120*a* would not be interrupted.

Optionally, the washing machine with multiple tubs according to this embodiment can be embodied in structure of a two-tub, three-tub, four-tub, or five-tub configuration.

Optionally, as shown in FIG. 12, the washing machine with multiple tubs as shown in this fourth preferred embodiment is not limited to the structure comprising the rotary tub 12*a*, the stationary tub 11 and the pulsator 50. In other words, the first main washing space 11*a* and the second washing space 11*b* may be embodied with a single dehydration, spin-drying, or dryer function of drying laundries without washing function.

Figure 8:
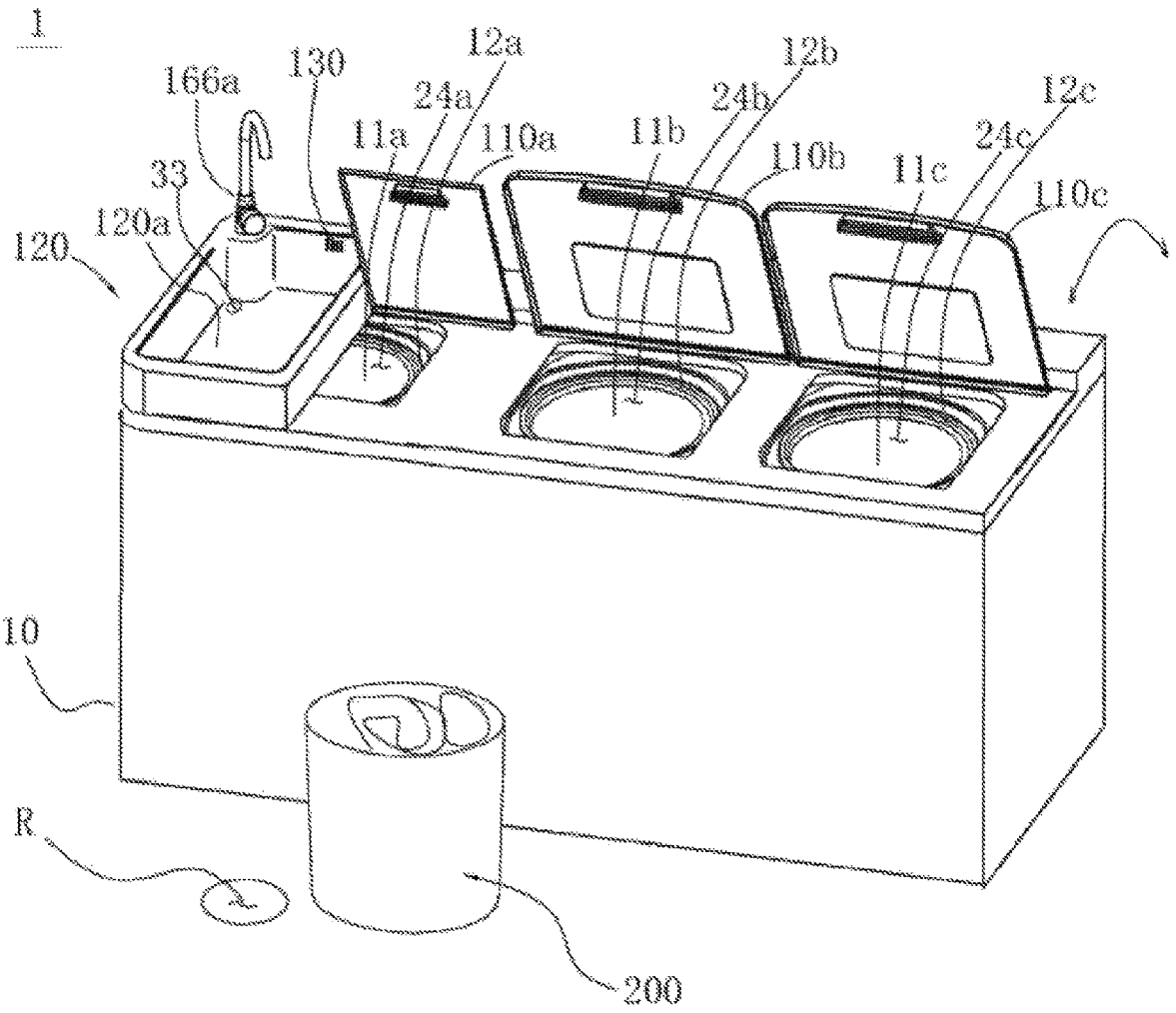
FIGS. 8, 9 and 10 are perspective views illustrating different alternative modes of the washing machine with several tubs and the auxiliary washing unit according to a seventh preferred embodiment of the present invention.

Optionally, as shown in FIG. 8, the washing machine with multiple tubs as shown in this fourth preferred embodiment is not limited to the structure comprising the rotary tub 12*a*, the stationary tub 11 and the pulsator 50. In other words, the first main washing space 11*a* or the second washing space 11*b* is embodied to have the washing function only without the drying function.

The washing machine according to this embodiment can be operated by two users standing at the positions illustrated by the marks R1 and R2 respectively.

One user standing at the position R1 is adapted to operate face washing or hand washing laundries including soaking the laundries to soften hard dirt and stains thereon inside the hand-washing container 120*a*, while another user standing at the position R2 performs washing operation of putting laundries into or taking laundries out of the second main washing space 11*b* for washing operation, wherein both users would not interfere with each other.

Hereinafter, a washing machine according to a fifth preferred embodiment of the present invention is illustrated, wherein the components and configuration which are the same of the above first, second, third, and fourth preferred embodiment are not repeatedly described in the following.

Figure 6:
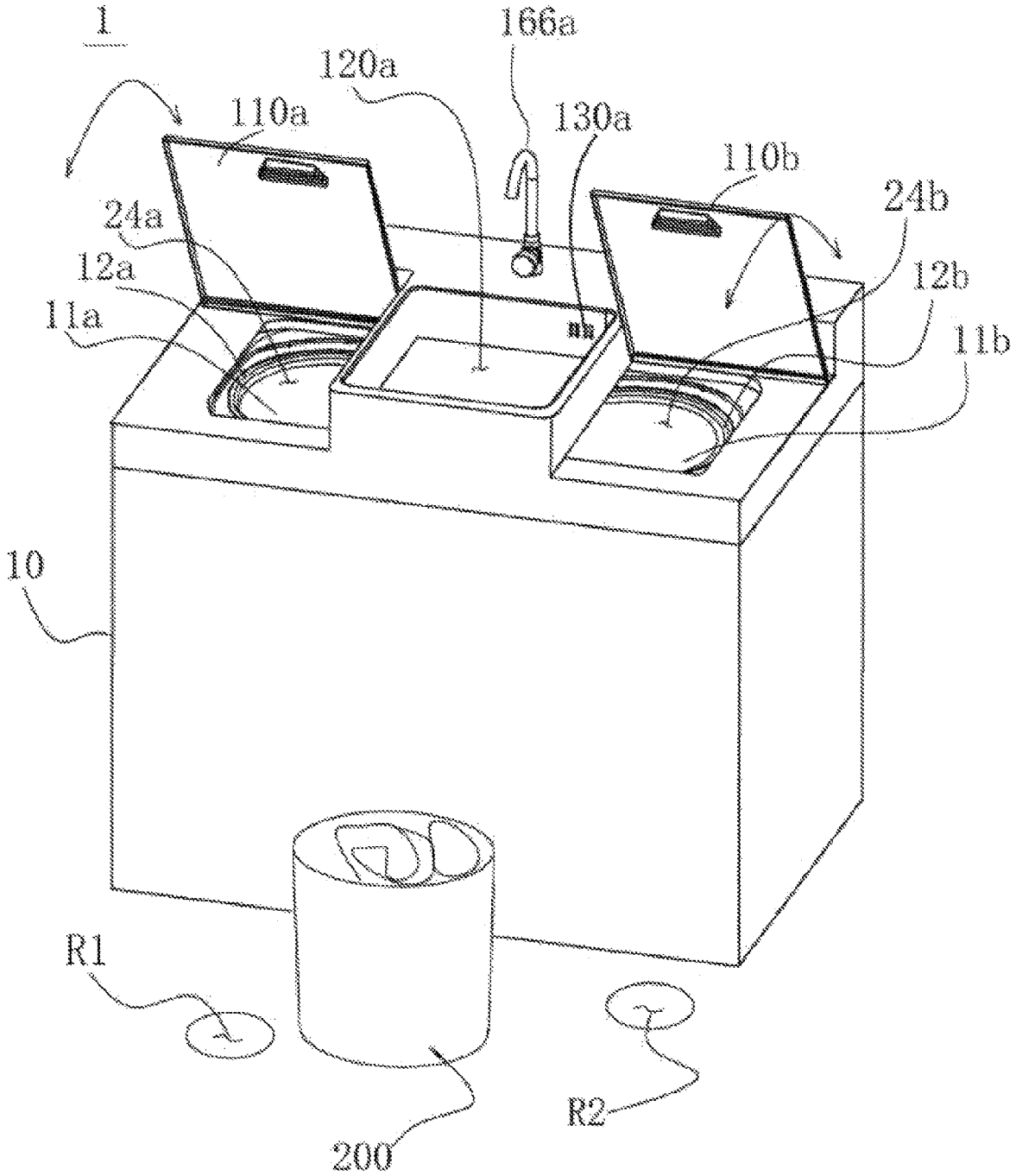
FIG. 6 is a perspective view of the washing machine according to a fifth preferred embodiment of the present invention.

Referring to FIG. 6, the washing machine according to the fifth preferred embodiment of the present invention comprises a main washing machine body 10, a first cover 110*a*, a second cover 110*b*, and a first auxiliary washing unit 120. The main washing machine body 10 has a first opening 24*a* provided at one top side thereof, a first main washing space 11*a* communicated with the first opening 24*a*, and a second opening 24*b* provided at another top side thereof, and comprises a second dryer unit 18*b* communicated with the second opening 24*b*, wherein the first auxiliary washing unit 120 is arranged on the main washing machine body 10 and positioned between the first main washing space 11*a* and the second dryer unit 18*b* in such a manner that the first auxiliary washing unit 120 covers a portion of the first opening 24*a* of the first main washing space 11*a* and a portion of the second opening 24*b* of the second dryer unit 18*b*. Correspondingly, the first cover 110*a* is configured to open and close another portion of the first opening 24*a* and the second cover 110*b* is configured to open and close another portion of the second opening 24*b*. In other words, the first auxiliary washing unit 120 and the first cover 110*a* are arranged juxtaposedly to cover the first opening 24*a*, while the first auxiliary washing unit 120 and the second cover 110*b* are arranged juxtaposedly that cover the second opening 24*b*.

The above-mentioned first auxiliary washing unit 120 is also defined as a hand-washing container 120*a* which can be used for soaking laundries to soften hard dirt and stains thereon, hand-washing laundries or washing faces.

The position illustrated as R1 in FIG. 6 is the position where the user stands. When the user opens the first cover 110*a*, the laundries to be washed are putted into the rotary tub 12*a* through the first opening 24*a* by opening the first cover 110*a*, wherein the operation of putting laundries into or taking laundries out of the first rotary tub 12*a* through the first opening 24*a* would not interrupt or affect the hand-washing operation in the hand-washing container to soak the laundries for softening hard dirt and stains thereon without wasting washing water.

When the user opens the second cover 110*b*, the laundries to be washed would be putted into the second dryer unit 18*b* through the second opening 24*b* after opening the second cover 110*b*. The operation of putting laundries into or taking laundries out of the second dryer unit 18*b* through the second opening 24*b* would not interrupt or affect the hand-washing operation in the hand-washing container 120*a* including soaking the laundries for softening hard dirt and stains thereon without wasting washing water.

The above-mentioned washing machine can achieve synergies of user's space requirements of different kinds of laundries 200 operation inside the laundry basket, the first main washing space 11*a*, the hand-washing container 120*a*, and the second dryer unit 18*b*.

The washing machine as shown in FIG. 6 in comparison with the washing machine as shown in FIG. 1 has more coordination functions for users to choose, and may better achieve efficient washing, save time, and reduce operation intensity.

The washing machine 1 according to the fifth preferred embodiment of the present invention does not increase the floor space of the washing machine 1 and does not occupy much of the user's living space while obtaining multiple washing operation spaces. Moreover, the washing machine allows the operation of putting laundries into or taking laundries out of the first main washing space 11*a* and/or the second dryer unit 18*b* while the hand-washing laundry work or the soaking to soften hard dirt and stains on the laundry work in the upper hand-washing container would not be interrupted.

The washing machine according to this fifth preferred embodiment can be operated by two users standing at the positions illustrated as the marks R1 and R2 respectively.

One user standing at the position R1 may perform face washing or hand-washing such as soaking laundries for softening hard dirt and stains thereon inside the hand-washing container 120*a*, while another user standing at the position R2 performs operation of putting laundries into or taking laundries out of the second dryer unit 18*b* for drying operation, wherein the two users would not interfere with each other.

Hereinafter, a washing machine according to a sixth preferred embodiment of the present invention is illustrated, wherein those components and configuration which are the same as the above first to fifth preferred embodiments would not be repeatedly described in the following.

Figure 7:
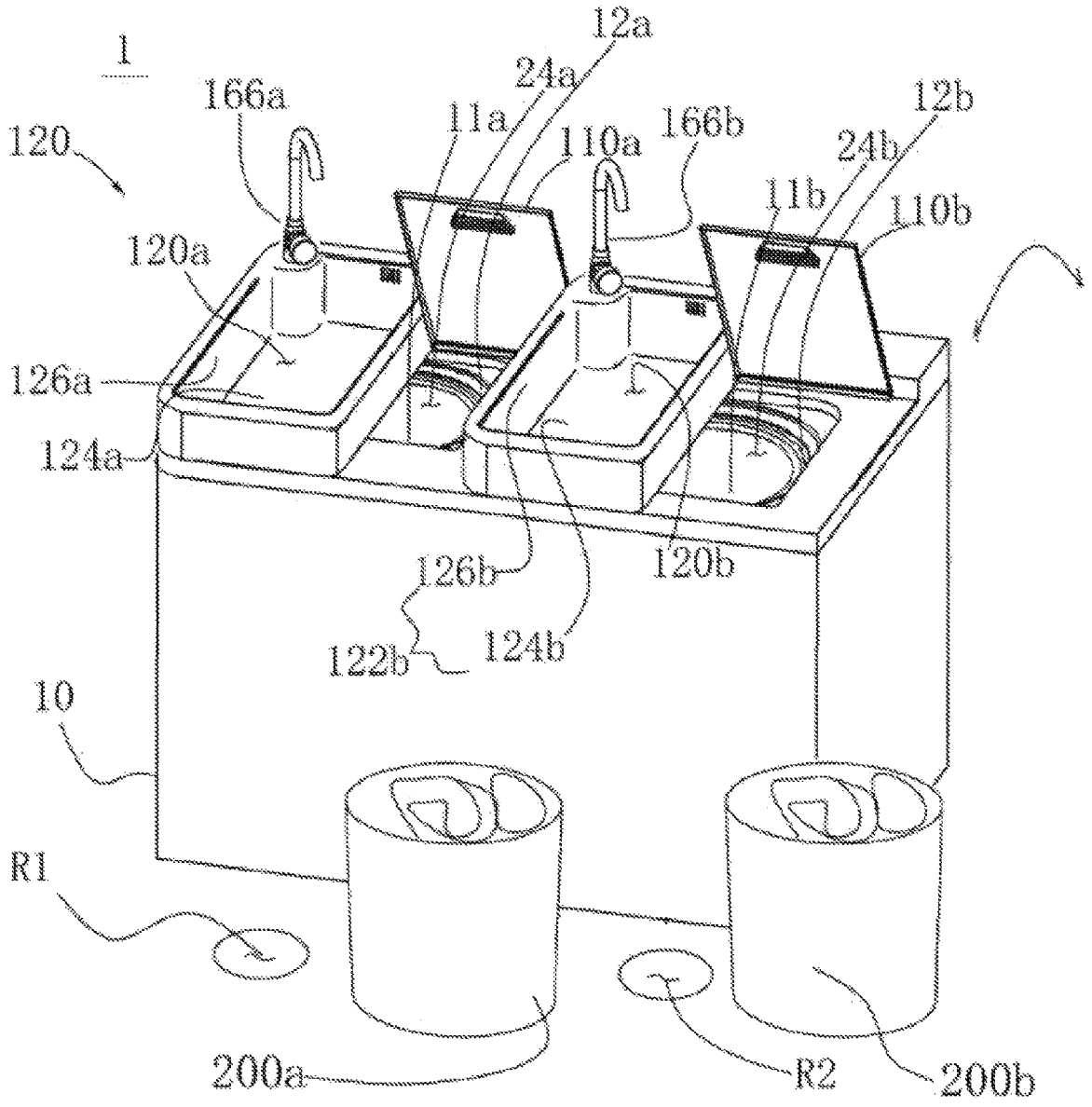
FIG. 7 is a perspective view of the washing machine according to a sixth preferred embodiment of the present invention.

Referring to FIG. 7, the washing machine according to the sixth preferred embodiment of the present invention comprises a main washing machine body 10, a first cover 110*a*, a second cover 110*b*, a first auxiliary washing unit 120*a* and a second auxiliary washing unit 120*b*. The main washing machine body 10 has a first opening 24*a* formed at one top side thereof, a first main washing space 11*a* communicated with the first opening 24*a*, a second opening 24*b* formed at another top side of thereof, and a second main washing space 11*b* communicated with the second opening 24*b*. The first auxiliary washing unit 120 and the first cover 110*a* are arranged juxtaposedly that cover the first opening 24*a* of the first main washing space 11*a*, wherein the first auxiliary washing unit 120 covers a portion of the first opening 24*a* and the first cover 24*a* is configured for covering another portion of the first opening 24*a* so that the first cover 110*a* is configured to be capable of opening and closing the another portion of the first opening 24*a* for putting laundries into or taking laundries out of the first main washing space 11*a* through the another portion of the first opening 24*a* after opening the first cover 110*a*. The second auxiliary washing unit 120*b* and the second cover 110*b* are arranged juxtaposedly that cover the second opening 24*b* of the second main washing space 11*b*, wherein the second auxiliary washing unit 120*b* covers a portion of the second opening 24*b* and the second cover 24*b* is configured for covering another portion of the second opening 24*b* so that the second cover 110*b* is configured to be capable of opening and closing the another portion of the second opening 24*b* for putting laundries into or taking laundries out of the second main washing space 11*b* through the another portion of the second opening 24*b* after opening the second cover 110*b*.

The first auxiliary washing unit 120 is defined as a hand-washing container 120*a*. Both the hand-washing container 120*a* and the second auxiliary washing unit 120*b* can be used for hand-washing operation such soaking laundries for softening hard dirt and stain thereon, hand washing laundry, or face washing. And, the second auxiliary washing unit 120*b* can be manufactured with the same structure as the hand-washing container 120*a*. In other words, the second auxiliary washing unit 120*b* comprises a unit body 122*a* having a bottom portion 124*a* and a side portion 126*a*. The washing water can be supplied via the auxiliary water supply pipe 166*a*, 166*b* in the first and second auxiliary washing units 120*a*, 120*b* respectively. According to the requirement of user, the second auxiliary washing unit 120*b* can be configured in different structure to perform similar function.

The positions illustrated as R1 and R2 in FIG. 7 are the positions where one or two users stand. When the user opens the first cover 110*a*, the laundries to be washed could be putted into the first rotary tub 12*a* through the first opening 24*a* after opening the first cover 110*a*. The operation of putting laundries into or taking laundries out of the first rotary tub 12*a* through the first opening 24*a* would not interrupt or affect the hand washing operation in the first hand-washing container 120*a*, such as soaking laundries for softening hard dirt and stains thereon without wasting washing water.

When the user opens the second cover 110*b*, the laundries to be washed could be putted into the second rotary tub 12*b* through the second opening 24*b* after opening the second cover 110*b*. The operation of putting laundries into or taking laundries out of the second rotary tub 12*b* through the second opening 24*b* would not interrupt or affect the hand washing operation in the second hand-washing container 120*b*, such as soaking laundries for softening hard dirt and stains thereon without wasting washing water.

The above-mentioned washing machine can achieve synergies of user's space requirements of different kinds of laundries 200 operation inside the laundry baskets, the first main washing space 11*a*, the hand-washing container 120*a*, the second main washing space 11*b*, and the second auxiliary washing unit 120*b*.

The washing machine in this sixth preferred embodiment can be operated by two users standing at the positions illustrated by the marks R1 and R2 respectively.

The washing machine as shown in FIG. 7 in comparison with the washing machine as shown in FIG. 1 has more coordination functions for users to choose, and may achieve efficient washing, save time, and reduce operation intensity.

The washing machine 1 according to the sixth preferred embodiment of present invention does not increase the floor space for the washing machine 1 and does not occupy much of the user's living space while obtaining multiple washing operation spaces. Moreover, it allows the operations of putting laundries into or taking laundries out of the first main washing space 11*a* and the second main washing space 11*b* while the hand-washing work, including soaking laundries for softening hard dirt and stains thereon, in the upper hand-washing container would not be interrupted.

Hereinafter, a washing machine according to a seventh preferred embodiment of the present invention is illustrated in the following.

Figure 9:
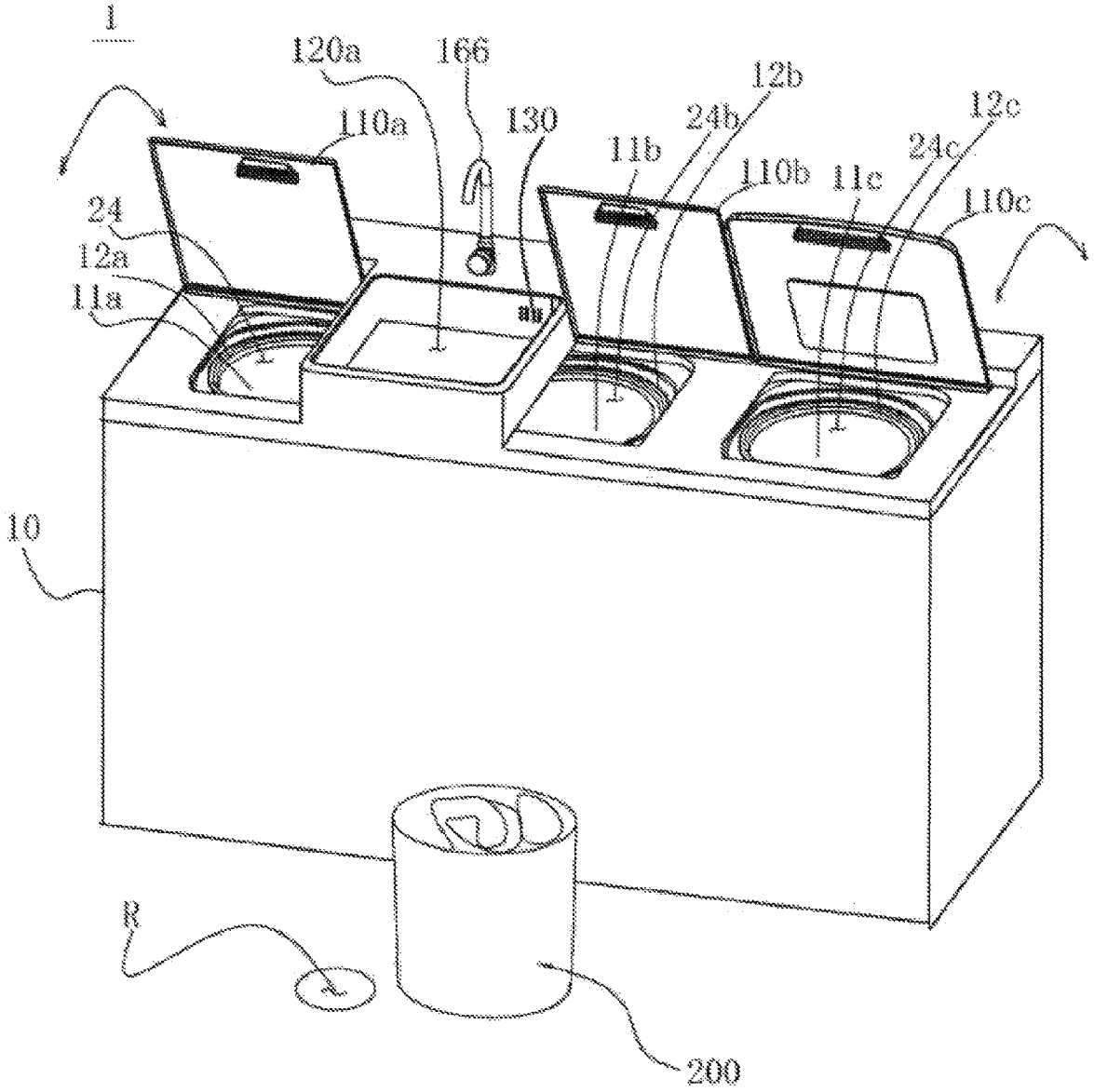
Figure 10:
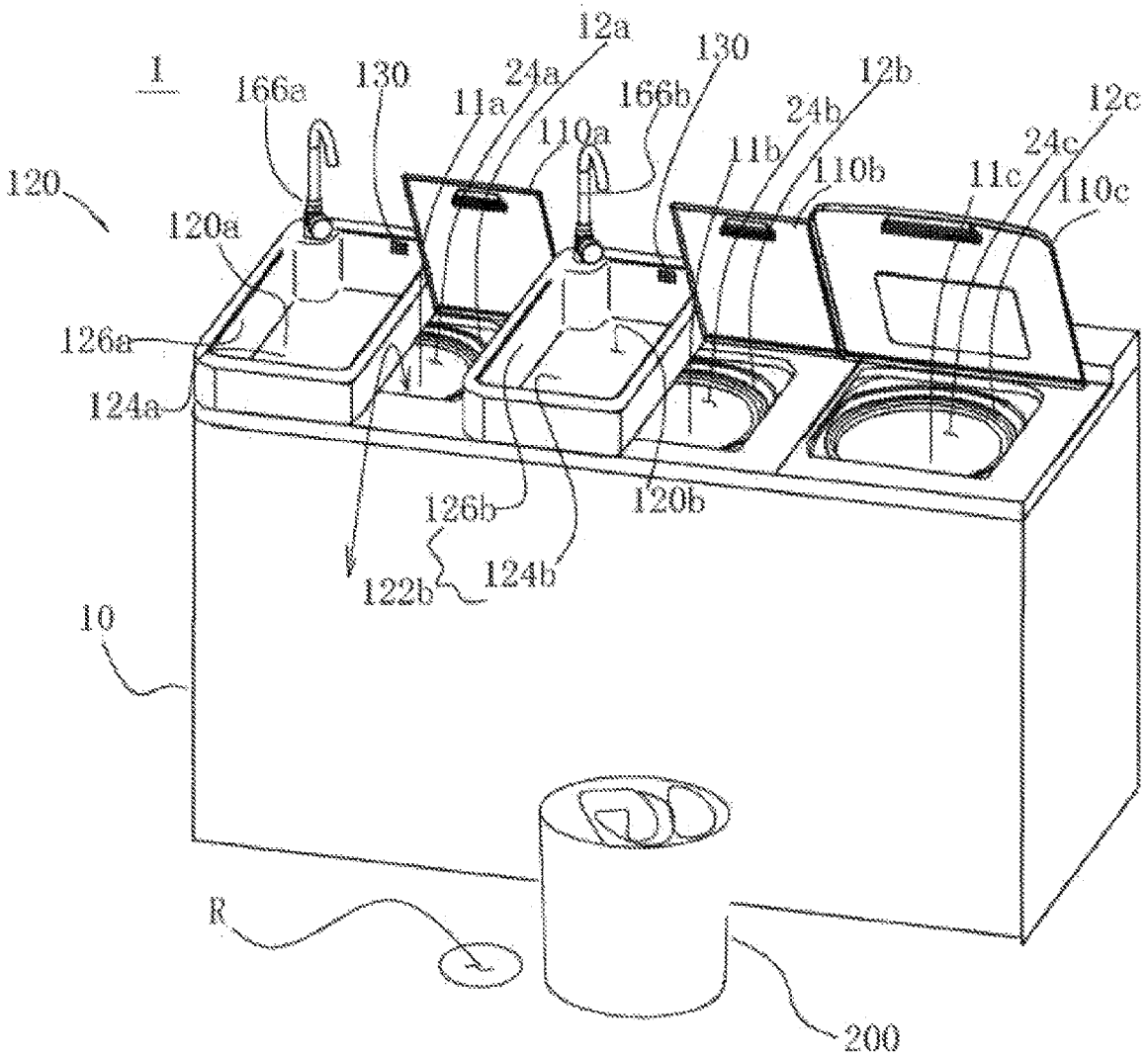

Optionally, as shown in FIG. 8, FIG. 9, and FIG. 10, the washing machine according to this seventh preferred embodiment is illustrated as a three-tub configuration. Of course, it may also be other four-tub, five-tub, or multi-tub configurations according to the needs. In addition, the seventh preferred embodiment of the present invention is not limited to the structure with the first rotary tub 12*a*, the second rotary tub 12*b*, the third rotary tub 12*c*, the corresponding stationary tub, and the pulsator. The main washing space could be a laundry operation tub having the dehydration, spin-drying or dryer function only.

In FIG. 8, a third opening 24*c* is communicated with a third main washing space 11*c* of the washing machine, and a third cover 110*c* is configured to be capable of opening and closing the third opening 24*c*. The first auxiliary washing unit 120 and the first cover 110*a* are juxtaposedly arranged to jointly cover the first opening 24*a* of the main washing space 11*a*, wherein the first auxiliary washing unit 120 is arranged covering a portion of the first opening 110*a* and the first cover 24*a* is configured to cover another portion of the first opening 110*a*. Other components and configurations are the same as those in the above first to sixth preferred embodiments.

The washing machine as shown in FIG. 9 is different from the washing machine as shown in FIG. 8 in that, the first auxiliary washing unit 120 is arranged on the main washing machine body 10 and positioned between the first main washing space 11*a* and the second main washing space 11*b*, wherein the first auxiliary washing unit 120 covers a portion of the first opening 24*a* of the first main washing space 11*a* and a portion of the second opening 24*b* of the second main washing space 11*b*.

The washing machine as shown in FIG. 10 is different from the washing machine as shown in FIG. 8 in further comprising a second auxiliary washing unit 120*b*, wherein the second auxiliary washing unit 120*b* and the second cover 110*b* are arranged juxtaposedly to jointly cover the second opening 24*b* of the second main washing space 11*b*.

Hereinafter, a washing machine according to an eighth preferred embodiment of the present invention is illustrated and described in the following.

Optionally, as shown in FIG. 11, this embodiment illustrates that the laundry operation tub as shown in the first embodiment, the second embodiment, the third embodiment, the fourth embodiment, the fifth embodiment, the sixth embodiment, the seventh embodiment, and the eighth embodiment is not limited to a structure having a rotary tub, a stationary tub, and a pulsator. In other words, the first main washing space 11*a* or the second washing space 11*b* is embodied as an individual washing functional structure without the dehydration, spin-drying or dryer function.

Hereinafter, a washing machine according to a ninth embodiment of the present invention is illustrated and described in the following.

Optionally, as shown in FIG. 12, this embodiment illustrates that the laundry operation tub as shown in the first embodiment, the second embodiment, the third embodiment, the fourth embodiment, the fifth embodiment, the sixth embodiment, the seventh embodiment, or the eighth embodiment is not limited to a structure having a rotary tub, a stationary tub, and a pulsator. In other words, the first main washing space 11*a* or the second washing space 11*b* is embodied as an individual dryer structure without water washing function.

Figure 13:
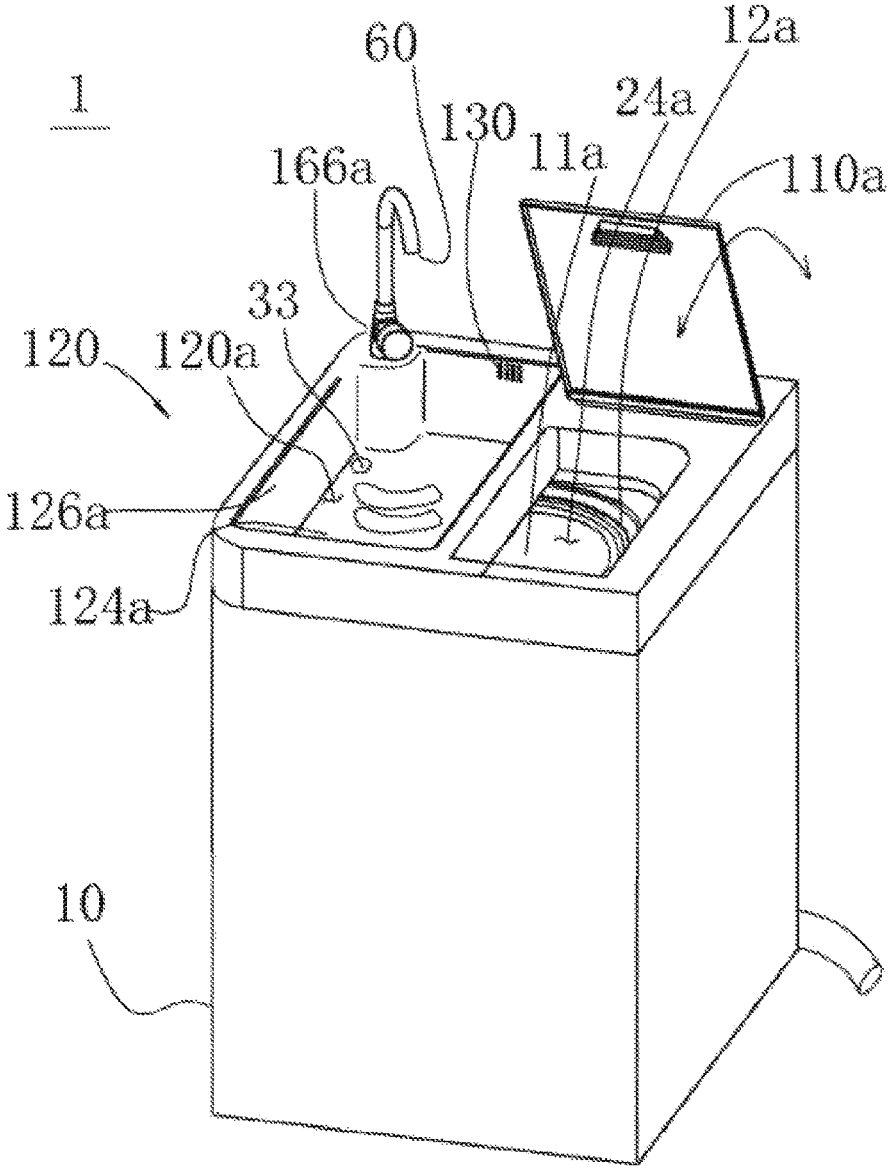
FIG. 13 is a perspective view of the washing machine according to a tenth preferred embodiment of the present invention.

Hereinafter, a washing machine according to a tenth preferred embodiment of the present invention is illustrated. As shown in FIG. 13, a different structure of an auxiliary washing unit of a washing machine according to the tenth preferred embodiment of the present invention is disclosed.

Optionally, a height difference is provided between a top surface of the first auxiliary washing unit 120 and an upper surface of the main washing space 11*a* and designed according to user needs. As shown in FIG. 13, the top surface of the first auxiliary washing unit 120 and the upper surface of the first cover 110*a* provided above the main washing space are in same height level.

Hereinafter, a washing machine according to an eleventh preferred embodiment of the present invention is illustrated and described.

Optionally, the hand-washing container 120*a* is provided with a washboard (not shown) on its upper surface, and a size of the washboard is not configured to cover the space communicating with the hand-washing container 120*a*, so as to allow the laundries being putted into or taken out of the hand-washing container 120*a* below the washboard while washing laundry thereon.

Optionally, the size of the washboard may also made to fully cover the hand-washing container 120*a* so as to maximize the washing area of the washboard 110*a*.

Optionally, according to the requirement of the user, the washboard is hinged with the hand-washing container 120*a*, wherein the hinge connection position can be set close to a position where the user works and stands. It can also be set at the left side, right side or rear side of the main washing machine body 10.

Optionally, the washboard may comprises one or more friction protrusions (not shown) protruded thereon according to the requirement of the user.

The protruded friction protrusions can promote auxiliary washing during scrubbing. The friction protrusions can be designed to form anywhere on the surface of the washboard. The friction protrusions are used to increase the frictional force with the laundry to be washed during hand-washing, so that the dirt and stain thereon are easily washed out from the laundry to be washed. However, the shape and arrangement of the friction protrusions are not limited.

Figure 14:
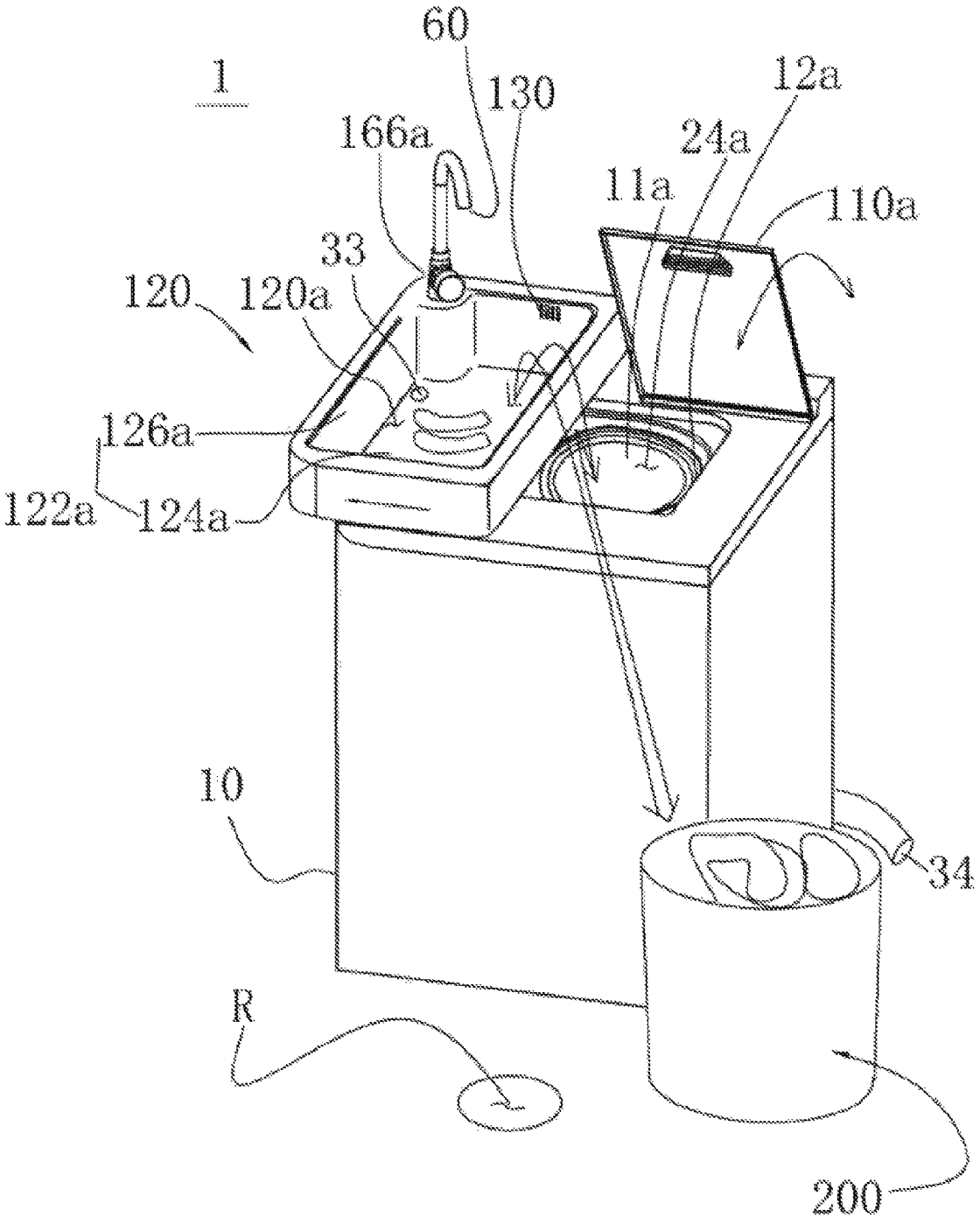
FIG. 14 is a perspective view of the washing machine according to an eleventh preferred embodiment of the present invention.

Hereinafter, a washing machine according to a twelfth preferred embodiment of the present invention is illustrated. Referring to FIG. 14, in order to easily putting laundries into or taking laundries out of the first main washing space 11*a*, the first auxiliary washing unit 120 is movably arranged on the main washing machine body 10. In this embodiment, an installation pulley (not shown) is provided in between the bottom surface of the first auxiliary washing unit 120 and the main washing machine body 10, so that even if the first auxiliary washing unit 120 is filled with water and laundries, the first auxiliary washing unit 120 can be easily slid away sidewardly. Alternatively, a slide rail and a slider may be provided between the bottom surface of the first auxiliary washing unit 120 and the main washing machine body 10.

Optionally, the main washing machine body 10 further comprises a front wing located on the front side of the first auxiliary washing unit 120, or/and a rear wing located on the rear side of the first auxiliary washing unit 120, wherein the first auxiliary washing unit 120 may be connected to the front wing or/and the rear wing by slide rail and slider, so that the first auxiliary washing unit 120 can be moved to the left and away from the first opening 24*a*.

During operation, when the first auxiliary washing unit 120 is pulled to the left in the direction of the arrow as shown in FIG. 14, the entrance to the first main washing space 11*a* for putting or taking laundries will be enlarged, as can be shown in FIG. 14. The first opening 24*a* can be completely exposed without affecting the insertion speed of the putting laundries.

Of course, the main washing machine body 10 further comprises a left side wing on the left side of the first auxiliary washing unit 120, wherein the first auxiliary washing unit 120 may be connected to the slide unit to the left wing, so that the first auxiliary washing unit 120 may be moved forward or backward away from the first opening 24*a*. In other words, such a solution can also achieve the purpose of the first auxiliary washing unit 120 moved away from the first opening 24*a*.

Similarly, when the washing machine comprises a second auxiliary washing unit 120*b* (as shown in FIGS. 7 and 10), the second auxiliary washing unit 120*b* can also be moved in relative to the main washing machine body 10, and the moving structure of the second auxiliary washing unit 120*b* may be same as the above, and details are not described herein again.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. A washing machine with auxiliary washing unit for washing laundries, comprising:

a main washing machine body having a first main washing space therein, a first opening formed on a top of said main washing machine body and communicated with said first main washing space, a drain outlet formed at a bottom of said first main washing space, and a drain pipe communicating with said drain outlet for discharging washing water contained in said first main washing space to outside, wherein said first opening is divided into a first portion and a second portion;

a first cover configured to open and close a first portion opening of said first opening; and a first auxiliary washing unit positioned on top of said main washing machine body and configured for hand-washing laundries, wherein said first auxiliary washing unit has a first auxiliary washing space therein and a first auxiliary drain outlet provided at a bottom portion thereof and communicated with said drain pipe for discharging a washing water contained in said first auxiliary washing space through said first auxiliary drain outlet to outside via said drain pipe, wherein said first auxiliary washing unit and said first cover are arranged juxtaposedly that jointly cover the first opening, wherein said first auxiliary washing unit is positioned over said second portion of said first opening and covers said second portion of said first opening while said first cover is configured to cover said first portion of said first opening, such that said first cover is able to be closed to cover said first portion of said first opening and to be opened to open said first portion of said first opening for putting laundries into or taking laundries out of said main washing space through said first portion of said first opening.

2. The washing machine, as recited in claim 1, further comprising a second auxiliary washing unit and a second cover, wherein said main washing machine body further has a second main washing space therein and a second opening communicated with said second auxiliary washing unit, wherein said second cover is configured to cover said second opening such that said second opening is able to be opened by opening said second cover for putting laundries into or taking laundries out of said second main washing space.

3. The washing machine, as recited in claim 2, wherein said second cover is configured to open and close a first portion of said second opening, and said first auxiliary washing unit and said second cover are arranged juxtaposedly that jointly cover the second opening, wherein said first auxiliary washing unit is also positioned over said second opening and covers a second portion of said second opening and said second cover is configured to cover said first portion of said second opening, such that said second cover is able to be closed to cover said first portion of said second opening and to be opened to open said first portion of said second opening for putting laundries into or taking laundries out of said second main washing space through said first portion of said second opening.

4. The washing machine, as recited in claim 2, further comprising a second auxiliary washing unit arranged on top of said main washing machine body, wherein said second auxiliary washing unit has a second auxiliary washing space therein and a second auxiliary drain outlet provided at a bottom portion thereof and communicated with said drain pipe for discharging a washing water contained in said second auxiliary washing space through said second auxiliary drain outlet to outside via said drain pipe, wherein said second opening is divided into a first portion and a second portion and said second cover is configured to cover said first portion of said second opening, wherein said second auxiliary washing unit and said second cover are arranged juxtaposedly that jointly cover the second opening, wherein said second cover is configured to open and close said first portion of said second opening, and that said second auxiliary washing unit is positioned over said second portion of said second opening and covers said second portion of said second opening, such that said second cover is able to be closed to cover said first portion of said second opening and to be opened to open said first portion of said second opening for putting laundries into or taking laundries out of said second main washing space through said first portion of said second opening.

5. The washing machine, as recited in claim 2, wherein said first auxiliary washing unit further has a side portion defining a unit body with said bottom portion thereof, wherein said unit body has a predetermined depth forming a hand-washing container, wherein said first auxiliary washing unit further comprises a water supply device comprising an auxiliary water supply pipe having an auxiliary water supply outlet provided at one side of said first auxiliary washing unit for supplying washing water through said auxiliary water supply pipe into said first auxiliary washing unit for laundry washing, hand washing and face washing.

6. The washing machine, as recited in claim 2, wherein said first auxiliary washing unit further has a side portion defining a unit body with said bottom portion thereof, wherein said unit body has a predetermined depth forming a hand-washing container, wherein said first auxiliary washing unit further comprises a water supply device comprising an auxiliary water supply pipe having an auxiliary water supply outlet provided at one side of said first auxiliary washing unit for supplying washing water through said auxiliary water supply pipe into said first auxiliary washing unit for laundry washing, hand washing and face washing.

7. The washing machine, as recited in claim 3, wherein said first auxiliary washing unit further has a side portion defining a unit body with said bottom portion thereof, wherein said unit body has a predetermined depth forming a hand-washing container, wherein said first auxiliary washing unit further comprises a water supply device comprising an auxiliary water supply pipe having an auxiliary water supply outlet provided at one side of said first auxiliary washing unit for supplying washing water through said auxiliary water supply pipe into said first auxiliary washing unit for laundry washing, hand washing and face washing.

8. The washing machine, as recited in claim 4, wherein each of said first and second auxiliary washing units further has a side portion defining a unit body with said bottom portion thereof, wherein said unit body has a predetermined depth forming a hand-washing container, wherein each of said first and second auxiliary washing units further comprises a water supply device comprising an auxiliary water supply pipe having an auxiliary water supply outlet provided at one side thereof for supplying washing water through said auxiliary water supply pipe into said corresponding first and second auxiliary washing units for laundry washing, hand washing and face washing.

9. The washing machine, as recited in claim 1, wherein said first main washing space is defined by a washing tub selected from the group consisting of a rotary tub for washing laundries and a dryer tub for drying laundries.

10. The washing machine, as recited in claim 2, wherein said first main washing space is defined by a washing tub selected from the group consisting of a rotary tub for washing laundries and a dryer tub for drying laundries.

11. The washing machine, as recited in claim 3, wherein said first main washing space is defined by a washing tub selected from the group consisting of a rotary tub for washing laundries and a dryer tub for drying laundries.

12. The washing machine, as recited in claim 4, wherein said first main washing space is defined by a washing tub selected from the group consisting of a rotary tub for washing laundries and a dryer tub for drying laundries.

13. The washing machine, as recited in claim 5, wherein said first main washing space is defined by a washing tub selected from the group consisting of a rotary tub for washing laundries and a dryer tub for drying laundries.

14. The washing machine, as recited in claim 6, wherein said first main washing space is defined by a washing tub selected from the group consisting of a rotary tub for washing laundries and a dryer tub for drying laundries.

15. The washing machine, as recited in claim 7, wherein said first main washing space is defined by a washing tub selected from the group consisting of a rotary tub for washing laundries and a dryer tub for drying laundries.

16. The washing machine, as recited in claim 8, wherein said first main washing space is defined by a washing tub selected from the group consisting of a rotary tub for washing laundries and a dryer tub for drying laundries.

17. The washing machine, as recited in claim 5, wherein said first auxiliary washing unit has an overflow opening formed at an upper positioned of said side portion for discharging overflowing washing water in said first auxiliary washing unit.

18. The washing machine, as recited in claim 6, wherein said first auxiliary washing unit has an overflow opening formed at an upper positioned of said side portion for discharging overflowing washing water in said first auxiliary washing unit.

19. The washing machine, as recited in claim 7, wherein said first auxiliary washing unit has an overflow opening formed at an upper positioned of said side portion for discharging overflowing washing water in said first auxiliary washing unit.

20. The washing machine, as recited in claim 5, wherein each of said first and second auxiliary washing units has an overflow opening formed at an upper positioned of said side portion for discharging overflowing washing water in said corresponding first and second auxiliary washing units.

* * * * *